US008505212B2

(12) United States Patent
Slack et al.

(10) Patent No.: US 8,505,212 B2
(45) Date of Patent: Aug. 13, 2013

(54) METHOD FOR RECONDITIONING OR PROCESSING A FCR APG-68 TACTICAL RADAR UNIT

(75) Inventors: Howard C. Slack, Columbia, MD (US); Clare L. Milton, Baltimore, MD (US)

(73) Assignee: Slack Associates, Inc., Baltimore, MD (US)

( * ) Notice: Subject to any disclaimer, the term of this patent is extended or adjusted under 35 U.S.C. 154(b) by 7 days.

(21) Appl. No.: 13/373,385

(22) Filed: Nov. 14, 2011

(65) Prior Publication Data

US 2012/0204440 A1 Aug. 16, 2012

Related U.S. Application Data

(63) Continuation-in-part of application No. 12/256,447, filed on Oct. 22, 2008, now Pat. No. 8,082,681.

(51) Int. Cl.
*F26B 5/04* (2006.01)

(52) U.S. Cl.
USPC ..... 34/403; 34/408; 34/412; 219/687; 62/126; 414/217; 414/805

(58) Field of Classification Search
USPC ..... 34/403, 408, 412, 60, 77, 80, 90, 34/86, 210; 29/605, 602.1; 336/94, 188, 336/199; 360/137, 97.02; 219/687; 257/734; 62/126; 414/217, 805
See application file for complete search history.

(56) References Cited

U.S. PATENT DOCUMENTS

| | | | | |
|---|---|---|---|---|
| 2,300,910 | A | 9/1940 | Camilli | |
| 3,792,528 | A | 2/1974 | Schober | |
| 3,940,860 | A | 3/1976 | Unterreiner | |
| 4,250,628 | A * | 2/1981 | Smith et al. | 34/260 |
| 4,347,671 | A | 9/1982 | Dias et al. | |
| 4,424,633 | A | 1/1984 | Bernhardt et al. | |
| 4,437,082 | A | 3/1984 | Walsh et al. | |
| 4,882,851 | A | 11/1989 | Wennerstrum et al. | |
| 5,189,581 | A | 2/1993 | Schroder et al. | |
| 5,433,020 | A | 7/1995 | Leech | |
| 5,752,532 | A | 5/1998 | Schwenkler | |
| RE36,796 | E | 8/2000 | Sato et al. | |
| 7,061,362 | B2 | 6/2006 | Myers et al. | |
| 7,665,226 | B2 * | 2/2010 | Tsuruta et al. | 34/259 |
| 8,017,858 | B2 * | 9/2011 | Mann | 84/742 |

(Continued)

FOREIGN PATENT DOCUMENTS

| | | |
|---|---|---|
| DE | 19 501 323 | 7/1996 |
| JP | 61174707 | 8/1986 |
| JP | 11102829 | 4/1999 |

*Primary Examiner* — Steve M Gravini

(74) *Attorney, Agent, or Firm* — Breneman & Georges

(57) ABSTRACT

A method for improving the manufacture and reliability of new, remanufactured, repaired or reconditioned Fire Control Radar APG-68 tactical radar systems (FCR) utilized in military aircraft and providing such units with extended useful life expectancies equivalent to or better than new of the FCR APG-68 unit high frequency, high voltage dual mode radar transmitters that are deployed in over 1000 state-of-the-art military aircraft such as the F-15, F-16 and F-18 fighter aircraft, and B-1 bombers. The novel method extends the mean lifetime of previously repaired and repairable FCR APG-68 tactical radar units and radar units and ageing transmitters from about 100 to a few hundred hours to about five hundred or more hours by the step of removing embedded moisture and absorbed moisture from the heterogeneous electronic components in the FCR APG-68 tactical radar unit.

30 Claims, 13 Drawing Sheets

| Date & Time | Days | Hours Under Vacuum at Temperature |
|---|---|---|
| 1/17/08 13:10 | | |
| 1/17/08 13:39 | 0.0201 | 0.48 |
| 1/17/08 13:59 | 0.0340 | 0.82 |
| 1/17/08 14:18 | 0.0472 | 1.13 |
| 1/17/08 15:30 | 0.0972 | 2.33 |
| 1/17/08 15:38 | 0.1028 | 2.47 |
| 1/18/08 12:02 | 0.9528 | 22.87 |
| 1/19/08 16:07 | 2.1229 | 50.95 |
| 1/21/08 11:10 | 3.9167 | 94.00 |

| Hours B-1 Initial Evacuation @ 85 C. | mT/Min. | mg/Min. |
|---|---|---|
| 0.48 | 106.7 | 80.0 |
| 0.82 | 84.7 | 63.5 |
| 1.13 | 63.9 | 47.9 |
| 2.33 | 42.5 | 31.9 |
| 2.47 | 37.5 | 28.1 |
| 22.87 | 21.4 | 16.1 |
| 50.95 | 3.16 | 2.4 |
| 94.00 | 1.26 | 0.9 |

(56) References Cited

U.S. PATENT DOCUMENTS 8,051,637 B2 * 11/2011 Labrador ..... 60/39.01
8,056,256 B2 * 11/2011 Slack et al. ..... 34/403
8,082,681 B2 * 12/2011 Slack et al. ..... 34/408
8,174,691 B1 * 5/2012 Horton et al. ..... 356/246
8,251,916 B2 * 8/2012 Speeg et al. ..... 600/565
8,387,948 B2 * 3/2013 Kuehl et al. ..... 251/149
2003/0183929 A1 10/2003 Boguslavsky

* cited by examiner

| Date & Time | Days | Hours Under Vacuum at Temperature |
|---|---|---|
| 1/17/08 13:10 | 0.0201 | 0.48 |
| 1/17/08 13:39 | 0.0340 | 0.82 |
| 1/17/08 13:59 | 0.0472 | 1.13 |
| 1/17/08 14:18 | 0.0972 | 2.33 |
| 1/17/08 15:30 | 0.1028 | 2.47 |
| 1/17/08 15:38 | 0.9528 | 22.87 |
| 1/18/08 12:02 | 2.1229 | 50.95 |
| 1/19/08 16:07 | 3.9167 | 94.00 |
| 1/21/08 11:10 | | |

B-1 Initial Evacuation @ 85 C.

| Hours | mT/Min. | mg/Min. |
|---|---|---|
| 0.48 | 106.7 | 80.0 |
| 0.82 | 84.7 | 63.5 |
| 1.13 | 63.9 | 47.9 |
| 2.33 | 42.5 | 31.9 |
| 2.47 | 37.5 | 28.1 |
| 22.87 | 21.4 | 16.1 |
| 50.95 | 3.16 | 2.4 |
| 94.00 | 1.26 | 0.9 |

First Redrying of B-1 after 3 Days Exposure to Shop Atmosphere

| Days | Hours | mT/Min. | gm. | mg / min. |
|---|---|---|---|---|
| 1/24/08 13:45 B-1 into Chamber | | | | |
| 1/24/08 14:30 Chamber Evacuated | | | | |
| 1/24/08 16:52 | 0.09861 | 2.37 | 10.50 | 1.02 | 7.9 |
| 1/24/08 18:24 | 0.16250 | 3.90 | 7.00 | | 5.3 |
| 1/25/08 11:13 | 0.86319 | 20.72 | 2.00 | | 1.5 |

Second Redrying of B-1 after ~3 Days Additional Exposure to Shop Atmosphere

| | Days | Hours | mT/Min. | gm | mg / min |
|---|---|---|---|---|---|
| 1/28/08 9:25 B-1 Into Chamber | | | | | |
| 1/28/08 10:15 Chamber Evacuated | | | | | |
| 1/28/08 10:47 | 0.02222 | 0.53 | 51.00 | | 38.3 |
| 1/28/08 11:22 | 0.04653 | 1.12 | 25.50 | | 19.1 |
| 1/28/08 11:52 | 0.06736 | 1.62 | 16.00 | | 12.0 |
| 1/28/08 12:22 | 0.08819 | 2.12 | 11.00 | | 8.3 |
| 1/28/08 13:25 | 0.13194 | 3.17 | 7.54 | | 5.7 |
| 1/28/08 14:40 | 0.18403 | 4.42 | 4.00 | | 3.0 |
| 1/28/08 15:22 | 0.21319 | 5.12 | 4.00 | | 3.0 |
| 1/28/08 16:22 | 0.25486 | 6.12 | 3.50 | 1.47 | 2.6 |

2nd Redrying of B 1 @ 85 C. after ~3 Days Additional Exposure

Third Redrying of B-1 after 7 Days Additional Exposure

| | Days | Hours | mT/Min. | gm | mg/Min |
|---|---|---|---|---|---|
| 2/4/08 11:30 | Reached Temperature at 70 Deg. C. | | | | |
| 2/4/08 12:35 | 0.04514 | 1.08 | 65.00 | | 48.8 |
| 2/4/08 17:30 | 0.25000 | 6.00 | 6.70 | | 5.0 |
| 2/5/08 10:30 | 0.95833 | 23.00 | 1.64 | | 1.2 |
| 2/6/08 11:13 | 1.98819 | 47.72 | 0.51 | 2.93 | 0.4 |

3rd Redrying of B-1 (@ 70 C.) after 7 Days Additional Exposure to Shop Atmosphere

Fourth Redrying of B-1 after 6 Days Additional Exposure

| Days | Hours | mT/Min. | gm | mg / min. |
|---|---|---|---|---|
| 2/12/08 12:20 Reached Temperature at 60 Deg. C. | | | | |
| 2/12/08 12:50 | 0.02083 | 0.50 | 50 | 37.5 |
| 2/12/08 13:04 | 0.03056 | 0.73 | 30 | 22.5 |
| 2/12/08 14:43 | 0.09931 | 2.38 | 10 | 7.5 |
| 2/12/08 17:53 | 0.23125 | 5.55 | 5.33 | 4.0 |
| 2/13/08 12:29 | 1.00625 | 24.15 | 1 | 0.8 |
| 2/13/08 15:48 | 1.14444 | 27.47 | 1 | 0.8 |
| 2/14/08 10:18 | 1.91528 | 45.97 | 0.29 | 1.3 | 0.2 |

4th Redrying of B-1 (@60 C.) after 6 Days Additional Exposure to Shop Atmosphere

METHOD FOR RECONDITIONING OR PROCESSING A FCR APG-68 TACTICAL RADAR UNIT

CROSS REFERENCE TO RELATED APPLICATIONS

This application is a continuation-in-part application of and claims the benefit of U.S. application Ser. No. 12/256,447 filed Oct. 22, 2008 now U.S. Pat.No. 8,082,681 and U.S. application Ser. No. 12/212,623 filed Sep. 17, 2008 now U.S. Pat. No. 8,056,256.

STATEMENT REGARDING FEDERALLY SPONSORED RESEARCH OR DEVELOPMENT

Not applicable.

INCORPORATION BY REFERENCE OF MATERIAL SUBMITTED ON COMPACT DISC

Not applicable.

REFERENCE TO A "MICROFICHE APPENDIX"

Not applicable.

BACKGROUND OF THE INVENTION

1. Field of the Invention

The invention pertains to a method and system for reconditioning or processing a heterogeneous collection of electronic components in a Fire Control Radar (FCR) high frequency, high voltage dual mode radar transmitter used in state-of-the-art military aircraft including the F-15, F-16, F-18 and B-1 bombers. More particularly the invention relates to a method and system for removing embedded moisture and absorbed moisture in newly manufactured and assembled units as well as from previously repaired and repairable FCR APG-68 tactical radar units to improve their normal life or to increase their normal repaired operational life from a few hundred hours or less to an expected life of about 500 hours or greater.

In one embodiment of the invention the novel method involves extensive drying without damaging the heterogeneous collection of electronic components in the FCR APG-68 tactical radar unit at temperatures between 40 and 105 degrees Celsius for periods of time from about 2 hours to 96 hours and preferably 4 to 48 hours when employing a vacuum pressure between 0.1 Torr and 10,000 milliTorr and preferably below 100 milliTorr and then sealing such electronic components or reassembling and filling the FCR APG-68 tactical radar unit with a dry gas within about 1 to 30 minutes and preferably less than 5 minutes after treatment and while the unit is still warm or above 50° C.

In a further embodiment of the invention the novel method involves removing absorbed and some adsorbed moisture from the heterogenous collection of components in new units or units which have not accumulated significant amounts of embedded moisture. These units are generally new units, units that have been recently treated in accordance with the alternative embodiment of the invention to remove embedded moisture or units that have not been repeatedly repaired and left exposed to moisture laden environments or atmospheres. Units treated in accordance with this embodiment of the invention are treated by removing the pneumatic fill valve generally referred to as a Schrader valve and the pressure relief valve and placing the new, recently remanufactured or repaired unit in a heating and evacuation chamber at a temperature of from about 40 to 100° C. and preferably 70° C. to 85° C. for a period of about 2 to 24 hours and preferably about 3 to 4 hours at a pressure less than 100 milliTorr and preferably less than 750 milliTorr. This application of the invention removes volatiles and absorbed and lightly adsorbed moisture and reduces the total moisture content of new, recently repaired or remanufactured units that have been treated to remove embedded moisture or units that have not been exposed to moisture laden environments or atmospheres.

In an alternative embodiment of the invention new units or units that have been treated in accordance with the alternative embodiment of the invention to remove embedded moisture or units that have not been repeatedly repaired in moisture laden environments may be treated in a heating chamber which has a vacuum line communicating with the pneumatic fill valve port and the pressure relief port of an assembled tactical radar unit which has been placed in a heating chamber. This alternative method of the invention eliminates the need for a combined heating and evacuation chamber and allows for the heating of the heating chamber at a temperature of about 40° C. to 100° C. and preferably at about 70° C. to 85° C. for a period of about 2 hours to 24 hours as the vacuum line attached to the fill valve port and the pressure relief port is evacuated to a pressure or less than 100 milliTorr and preferably less than 750 milliTorr.

2. Description of Related Art Including Information Disclosed Under 37 C.F.R. 1.97 and 1.98

High power radar transmitters fail periodically in service and are returned to depots for repair. At the depots the sulfur hexafluoride ($SF_6$) is removed from the high voltage high frequency power supply or high voltage section, which is enclosed in a sealed pressure vessel of the FCR APG-68 tactical radar dual mode transmitter. The pressure vessel is then opened and the electronic components within the high voltage section are exposed to the atmosphere of the shop while the failed component(s) are being located and replaced. The system is sometimes left open for days and even weeks. After reassembly the high voltage electronic package is sealed into the pressure vessel, which is then evacuated, heated and dried under vacuum and refilled with sulfur hexafluoride ($SF_6$). After being tested the transmitter is returned to service. It has been discovered by the inventors that the prior art evacuation heating and drying procedures removed only superficial moisture.

One of the problems not recognized in the prior art is that ground testing did not simulate long period testing under actual temperature conditions encountered in flight operations. Ground testing, while adequate for demonstrating operability of the reassembled unit, did not include actual operational conditions where high ground temperatures followed by rapid low temperature flight conditions resulted in changes in vapor pressure inside the sealed unit that are caused by two types of moisture, absorbed moisture and embedded moisture left in the unit, that reduce the life of the FCR APG-68 unit in service.

The best known prior art involves the original manufacture of the FCR APG-68 dual mode transmitters. In the original manufacture of the transmitters the partially assembled electronic assemblies (FIG. 6) were tested for corona discharge and other electrical characteristics while immersed in baths of Fluorinert™. After assembly they were evacuated in a pressure vessel to remove air so that they could be filled with sulfur hexafluoride ($SF_6$). Fluorinert™ evaporates without leaving any residue, but has a high boiling point and not all of it evaporates immediately. Originally Fluorinert™ residues contaminated the oil of vacuum pumps used for the subsequent evacuation and interfered with reaching a vacuum level in the milliTorr range. This problem was eliminated by adding the step of vacuum baking the electronic assemblies to remove Fluoriner™ prior to evacuation and filling with $SF_6$.

As manufactured relatively early in the FCR APG-68 program, the High Voltage, High Frequency Power Supply unit shown in FIG. 6 was vacuum-baked in an inverted position for about two hours, then its cold plate 50 (FIG. 3 and FIG. 6) was sealed to the aluminum high voltage pressure vessel 42 (FIG. 3) by means of an O-ring located just inside of the bolt holes (FIG. 3, 46). The closing and sealing was carried out while the assembly was still warm and was surrounded by an atmosphere consisting largely of nitrogen. This open vacuum-baking process unknowingly and unwittingly removed a lot of the moisture originally present in the components and absorbed during initial manufacture. Once repaired any moisture left at the time of original manufacture combined with the moisture absorbed from the atmosphere during the current repair which also added to the moisture adsorbed during previous repair operations to form harmful absorbed and embedded moisture that resulted in decreasing mean time between failure (MTBF) rates.

In the prior art repair process Fire Control Radar FCR APG-68 units are repaired and a final process performed on repaired transmitters is to evacuate them through a Schrader valve and a Schrader valve actuator while they are being heated and then to backfill the high voltage high frequency power supply with $SF_6$. The vacuum is drawn through passages in the Schrader valve that are only about 0.060 inch in diameter and whose conductance is, therefore, very low. As a result it is believed that only a small amount of moisture and possibly only the moisture already in the air within the pressure vessel is removed at the time of evacuation and heating. The bulk of the moisture that has been absorbed from the atmosphere in the shop during the repair process remains embedded in the various electronic components, largely in organic insulating materials and builds up as embedded moisture as a consequence of repeated repairs.

Over the last twenty years the mean-time-between-failure (MTBF) of the transmitters has been falling from over 500 hours of operational life to values in the low hundreds of hours. Frequently transmitters now fail after only a few tens of hours of operation after having been serviced and ground tested. Many of the FCR APG-68 units have therefore been repaired dozens of times with each repair likely adding to the total moisture embedded in the high voltage high frequency power supply.

The best known prior art which was employed during the original manufacturing process did not have as its primary purpose the removal of moisture and did not specifically quantitatively test for moisture removed. The prior art process of removing Fluorinert™ is believed to have unwittingly and unknowingly removed much of the moisture absorbed during the manufacturing process, leaving a quantity of tolerable moisture. This tolerable moisture included intrinsic moisture that could not be removed without removing volatile organic plasticizers and organic materials. This tolerable moisture and intrinsic moisture did not significantly impair the normal expected 500 hour MTBF rate. The standard practice of heating and evacuation through the Schrader valve at vacuums typically of 2 Torr does not remove the bulk of the moisture absorbed during the immediately preceding repair operation and is believed not to remove embedded moisture or moisture that was absorbed during previous repair operations.

The invidious nature of the absorbed and embedded moisture in the high voltage high frequency power supply was first recognized by the inventors after discovering the surprising amount of water removed from a high voltage high frequency power supply from an FCR APG-68 defective unit from a B-1 bomber as will be described hereinafter in greater detail. The amount of water removed as moisture is believed to have been deeply embedded in the organic components of the high voltage high frequency power supply. On the ground at a constant temperature the moisture content of the vapor space in the pressure vessel approaches an equilibrium with the moisture content of the organic and inorganic solid state materials in the high voltage high frequency power supply.

The time between flights would allow this equilibrium to be approached at sometimes high ground temperatures. However the rapid change in temperature encountered in flight level altitudes which change at about 1.4 degrees Centigrade per 1,000 feet can drop temperatures by 15° C. in about 10 seconds. Such a rapid cooling due to a rapid change in altitude results in a rapid rise in the relative humidity in the sealed high voltage high pressure vessel. As the relative humidity in the pressure vessel rises rapidly and exceeds 100% condensation would occur resulting in arcing, partial discharges and failure of the FCR APG-68 dual mode transmitter.

The deleterious effect of moisture on the electrical components and properties of insulators is well known. Camilli U.S. Pat. No. 2,300,910 refers to the vacuum treatment and drying to remove all moisture prior to the impregnation of the paper insulation in high voltage windings of transformers during their manufacture. Similarly Camilli U.S. Pat. No. 2,168,154 provides for drying of the core and windings of a transformer in a partial vacuum and Kolator U.S. Pat. No. 3,587,168 provides for the use of heat and vacuum in the manufacture of transformers. Temperatures in the range used for transformers are beyond the range that are tolerated by FCR APG-68 tactical radar units.

Many methods have been proposed for the drying of electronic components during manufacture such as Wennerstrum U.S. Pat. No. 4,882,851 which discloses the use of microwave heating. Microwave heating cannot be applied to an assembled FCR APG-68 tactical radar dual mode transmitter. Other prior art such as Schroder U.S. Pat. No. 5,189,581 discloses use of a desiccant for removing moisture from the housing of a videocassette recorder.

Leech U.S. Pat. No. 5,433,020 discloses use of a cold trap with a valve between vacuum pump and trap to maintain a fixed differential pressure to control flow rate during the vacuum drying of an object. In contrast the system of the invention employs a valve between cold trap and vacuum chamber to permit measurement of the rate of evolution of embedded and absorbed moisture.

Schober U.S. Pat. No. 3,792,528 dries windings of high voltage transformers, seals them, washes out the sealant and dries the transformer with kerosene vapor before filling with transformer oil. Kerosene vapor cannot be employed to dry FCR APG-68 tactical radar transmitters because of the difficulty in complete removal of the kerosene prior to filling with $SF_6$.

Inoue Tamotsu JP 61 174 707 improves the dielectric strength of the gas of a gas-filled transformer by intermittently circulating the gas through an external drier. This is not practical in an air-borne FCR APG-68 dual mode radar transmitter because the length of time required is so much greater than through the use of vacuum.

Ikuyo and Hiroyuki JP 11 329 328 employs a preliminary chamber to remove surface moisture by electron beam processing and applies heat and vacuum. Subsequently the samples are moved to a separate chamber. It is not practical to move units from one chamber to another for separate treatment due to the reacquisition of atmospheric moisture.

Michio, et al. JP 1110 2829 reduces the rate at which paper insulation deteriorates by heating electrical equipment under vacuum by passing current through the windings. This method of heating the windings is not practical for radar components within the high voltage section, which involve many different components other than transformer windings. Similarly Gmeiner Paul (DE 19 501 323) dries transformers and treats the oil by heating with current through the coils.

Boguslaysky US 2003 0183929 thermally conditions components on IV packages before and/or after repairing them in order to prevent moisture from damaging the packages when subsequently subjected to soldering temperatures. The need to maintain dryness of electrical packages that will be exposed to soldering temperatures for purposes of soldering is very different from removing moisture from FCR APG-68 radar transmitter units to increase their operational life. Dias U.S. Pat. No. 4,347,671 dries the interior of metal surfaces such as tubing for high purity gases by passing through a reactive gas; such a procedure would damage the components of a high voltage, high frequency power supply.

The premature failures of repaired FCR APG-68 units have resulted in extensive investigations in the prior art. Arcing and partial discharge and failure have been attributed to the contamination of Coolanol™ which is used as a circulating coolant for the FCR APG-68 tactical radar unit as well as to the contamination of the sulfur hexafluoride gas in the high voltage high frequency power supply.

It has been found by the inventors that failed FCR APG-68 tactical radar units contain contaminated Coolanol™ 25R exhibiting increased color, odor and viscosity and decreased resistivity and in extreme cases sludge. This sludge can be deposited on the heat exchanger surfaces or in the traveling wave tube (TWT). As a result the heat transfer coefficient and the flow rate can decrease because of the formation of solid contaminants that raise the temperature of the TWT, which accelerates the decomposition of the Coolanol™ 25R and the eventual malfunction of the FCR APG-68 tactical radar unit.

Those skilled in the art of FCR APG-68 tactical radar units have extensively investigated Coolanol™ 25R as a source of the problems of arcing, the creation of hot spots and the failure of FCR APG-68 tactical radar units. One study involved the replacement of Coolanol™ 25R with polyalphaolefin under the title *Coolanol* 25R *Replacement for Military Aircraft Cooling Systems AF*06-083, which contract was awarded to METSS Corporation of Westerville, Ohio and an Article entitled *Methodology for Comparison of Hydraulic and Thermal Performance of Alternative Heat Transfer Fluids in Complex Systems*, By Ghajar, Tang and Beam, Vol. 16, Issue 1 January-March 1995 *Heat Transfer Engineering.*

Those skilled in the art have also investigated the FCR APG-68 tactical radar unit as a function of the purity of sulfur hexafluoride ($SF_6$) or its contamination. $SF_6$ purity is important since the electronics package of the high voltage high frequency unit is sealed in an atmosphere of $SF_6$. There is however disagreement in the literature on the effect of moisture on the behavior of $SF_6$ in arcing and corona discharge.

As a result those skilled in the art have considered various options to remedy the premature ageing and high rate of failure of FCR APG-68 tactical radar units. The initial cost of acquisition at almost one million dollars a unit and their reduced service life and requirements for repair and maintenance have provided a great incentive for finding an acceptable method or procedure for remediating and upgrading the performance of these vital tactical radar units.

SUMMARY OF THE INVENTION

The FCR APG-68 tactical radar unit is an advanced pulse-Doppler radar having increased range and more modes than predecessor radar systems such as the FCR APG-66 radar units. The FCR APG-68 radar unit comes in a number of variants: the FCR APG-68 (V) 5, FCR APG-68 (V) 6, FCR APG-68 (V) 7, FCR APG-68 (V) 8 and FCR APG-68 (V) 9. The FCR APG-68 (V) 9 is to date the latest variation of the FCR APG-68 radar family and provides improved range and resolution and multimode fire control with improved search-while-track mode of four versus two targets and improved resistance to countermeasures. All members of the FCR APG-68 family provide the eyes of the advanced military fighter, bomber and tactical aircraft all of which include a high voltage power supply surrounded by sulfur hexafluoride ($SF_6$) in a sealed housing.

All of the FCR APG-68 variants FCR APG-68 (V) 5 to FCR APG-68 (V) 9 have similar high voltage assemblies surrounded by sulfur hexafluoride ($SF_6$) and have the similar problem of decreased mean time between failure (MTBF). The invention is applicable to all FCR APG-68 variants, FCR APG-68 (V) 5 to FCR APG-68 (V) 9 and will be collectively referred to as a FCR APG-68 tactical radar unit hereinafter and in the claims. These FCR APG-68 tactical radar units can be reconditioned to have high MTBF cycles in accordance with the method of the invention.

It has been discovered that the amounts of embedded moisture in FCR APG-68 tactical radar units have resulted in high failure rates and premature ageing. This discovery of the volume of moisture actually removed from the high voltage high frequency unit was surprising since all electronic equipment contains trace amounts of moisture and prior art techniques of heating and evacuation were believed sufficient to remove sufficient quantities of moisture and to leave only such trace amounts of moisture as would not impair the operational capabilities or operational life of the Fire Control Radar (FCR) APG-68 tactical radar unit. In fact the method of the invention in the preferred embodiment stops removing moisture at a level that avoids removing intrinsic moisture as well as most plasticizers and impregnating oils in the insulating materials.

Limitations on the MTBF and useful operational life and operational capabilities of the FCR APG-68 unit are due to the presence of embedded moisture and absorbed moisture. The presence of these types of moisture is believed not detected in standard testing after the unit is repaired, tested and returned to service because standard testing does not include repeated temperature cycling between high temperatures to which an aircraft is subjected on the ground and low temperatures encountered at high flight levels in operation. It is believed that temperature variations result in vapor pressure differentials that on the ground drive embedded moisture and absorbed moisture from the electronic components in the high frequency high voltage power supply which together with rapid cooling in flight cause hot spots, arcing and partial discharges due to the moisture condensation resulting in malfunctioning of the high voltage high frequency power supply.

The inventors have discovered that the contents of the high voltage high frequency power supply of the FCR APG-68 tactical radar units have absorbed very significant and hitherto unsuspected quantities of moisture from the atmospheres of the repair depots as the transmitters were being repaired—in spite of the drying and evacuation to which the FCR APG- 68 unit has been subjected prior to being recharged with $SF_6$. Over time this moisture is believed to become deeply embedded in the components of the high voltage section. This deeply embedded moisture becomes evident from the slow and decreasing rate at which it diffuses out of the assembly under vacuum at an elevated temperature of 70° C. Over ten grams of water have been removed from a single transmitter. This quantity of water is over 100 times the quantity required to establish a relative humidity of 50% in the free volume of the high voltage section at 25° C.

The quantity of embedded moisture absorbed in the high voltage section of a transmitter is many times that which can be accounted for by surface adsorption on components. The moisture is absorbed by the organic portions of the various components, which include transformers, coils, circuit boards, resistors, diodes, semiconductors, and especially insulating materials and components in the high voltage power supply. Some of the insulating material may contain cellulose. The insulation of high voltage transformers is normally oiled or resin-impregnated cellulose. These oil and resin-impregnation treatments only slow down the rate at which the cellulose portion absorbs and releases moisture.

The major components of the high voltage power supply section of the FCR APG-68 tactical radar unit from a B-1 bomber, from which 10 grams of water had been removed, subsequently absorbed 1.5 grams of moisture from the atmosphere of a typical shop in three days and 2.9 grams in seven days. This freshly absorbed moisture can be removed more rapidly than that which has been absorbed over the years since it has not had time to diffuse so deeply within the components. Freshly absorbed moisture and volatiles is being referred to herein as absorbed moisture and is easier to remove than embedded moisture which has remained in the high voltage high frequency power supply unit over repeated repair cycles.

For example, if 160 grams of dry cellulose contained the 10 grams of water that has been found in a power supply, its water content would be 6.25%, a value that it would reach if exposed for a long period of time to an atmosphere of 50% relative humidity at 20° C. If this cellulose were then sealed into a dry space of limited volume, such as the pressure vessel of a radar transmitter, water would desorb until the relative humidity reached about 35%. When the space was cooled down to 38° F. the space would be saturated with water vapor, with further cooling resulting in condensation.

In the field FCR APG-68 tactical radar units are subjected to rapid changes in temperature. The standard value for temperature as a function of altitude is 30.5° F. at only 8,000 feet. If necessary, an F-16 could reach this altitude in less than 10 seconds. Ambient conditions of high ground temperatures and low temperatures in flight are believed to result in increases in relative humidity or actual condensation in the sealed FCR APG-68 tactical radar unit that result in arcing, partial discharges and failure of the transmitter. The qualification tests on this transmitter when new involved warm-up times as short as 160 seconds and temperature cyclic tests during which power is turned on when the equipment has reached −54° C.

Due to the rapid changes in temperature in flight operations it is believed the embedded moisture has caused premature failure in FCR APG-68 tactical radar units. The failure and limited operational life of the FCR APG-68 tactical radar unit can be remedied in accordance with the invention by removing the embedded moisture that causes arcing, partial discharges and failure and unreliability of the dual mode transmitter in operation by utilizing the method of the invention.

The amount of embedded moisture in the electronics package of the FCR APG-68 high frequency, high voltage dual mode radar transmitter was discovered when the power supply chassis with the electronic components hereinafter referred to as power supply chassis or high voltage power supply or high voltage high frequency power supply of a failed FCR APG-68 unit was heated and evacuated. The power supply chassis of the FCR APG-68 tactical radar unit was evacuated and heated for three days at a temperature of about 85° C. and the evolved gases were collected in a trap at a temperature of about −80° C. and about 10.3 grams of water were recovered.

During the drying the rates at which moisture was evolved were determined periodically by closing a valve between the vacuum oven and the cold trap and observing the rates at which the pressure built up. In this way it was possible to distinguish between embedded moisture and recently absorbed moisture as well as superficial moisture that does not affect the service life of the FCR APG-68 tactical radar unit. The embedded moisture as used herein is moisture absorbed by the power supply chassis from the atmosphere, after repeated repairs and openings and leaving the power supply chassis exposed to laboratory atmospheres for periods equivalent to several weeks, that has diffused to the interior of components over periods of time during which the unit was sealed. The embedded moisture may include trace amounts of moisture present when the FCR APG-68 tactical radar unit was originally manufactured. The absorbed moisture as used herein is moisture absorbed from the atmosphere during a repair but which moisture has not had time to diffuse deeply into the interior of components.

In accordance with the method of the invention embedded moisture and absorbed moisture that reduce the mean time between failure due to arcing, hot spots and destabilization of the traveling wave tube (TWT) can be remediated by the removal of the embedded moisture and absorbed moisture from the high voltage power supply and other volatiles. The embedded moisture and absorbed moisture in the high voltage power supply can be removed by separately treating the high voltage high frequency power supply from an FCR APG-68 tactical radar unit operated over a period of time at a temperature of from about 40° C. to 105° C. with a circulating drying gas and a cold trap to remove water. The circulating drying gas should be dry and substantially inert to the collection of electronic components in the power supply of the FCR APG-68 tactical radar unit. Dry nitrogen is preferred but other dry or inert gases may be used such as carbon dioxide or an inert gas such as argon and neon could be utilized.

The cold trap should be operated below 0° C. and preferably at or below minus 70° C. A suitable oven for treating a high voltage power supply can be obtained from Slack Associates, Inc. in Baltimore, Md. with a Model Number 1061. Other suitable commercially available ovens may be obtained or constructed from commercially drying ovens available from a variety of sources.

The heating oven used for separately treating the high voltage power supply from an FCR APG-68 tactical radar unit should also include the ability to be evacuated while heating to reduce the period of time the high voltage power supply from the FCR APG-68 tactical radar unit is treated. A suitable oven should be capable operated at or below 10 Torr and preferably at a range of about 50 to 100 milliTorr and filled with a dry gas to reduce the time required to remove embedded moisture from the high voltage power supply from an FCR APG-68 tactical radar unit. A suitable heating oven for reconditioning a high voltage power supply can be obtained from Slack Associates, Inc. of Baltimore, Md. having a Model No. 1061.

The high voltage power supply from the FCR APG-68 tactical radar unit preferably should be treated in a suitable heating oven at about 70° to 80° C. for a period of about 50 to 100 hours at a pressure of 10 Torr or less. The heating oven should preferably have a circulating fan which is used for about an hour until the load approaches the target temperature at which time the circulating fan is turned off and the chamber is evacuated. The drying time can be reduced by increasing the temperature up to about 105° C. and reducing the vacuum down to 1 milliTorr at which point drying times may be reduced to as little as 4 to 5 hours. Temperatures at or above 105° C. and pressures below 1 milliTorr risk the undesirable removal of excessive quantities of plasticizers and impregnating oils that may result in the destruction of the high voltage power supply for the FCR APG-68 tactical radar unit.

Once the high voltage power supply for the FCR APG-68 tactical radar unit is treated it should be vacuum sealed or sealed in a dry gas such as nitrogen, carbon dioxide, sulfur hexafluoride or a dry and inert gas such as argon or helium until the high voltage high frequency power supply is reassembled into the FCR APG-68 tactical radar unit. In such a case the high voltage high frequency power supply should be only opened and reassembled in a dry controlled atmosphere.

Alternatively and preferably the reconditioned high voltage power supply should be removed partially from the heating oven and reassembled and sealed to the FCR APG-68 tactical unit and filled with a dry gas within 1 to 30 minutes after treatment and preferably within 5 minutes to prevent the high voltage power supply from reabsorbing moisture from the atmosphere.

The invention in the preferred embodiment also includes a method for reconditioning an FCR APG-68 tactical radar unit in which one or more of electronic components in the high voltage high frequency power supply have been replaced or reconditioned. This method is included within the broader method for reconditioning the high voltage high frequency power supply assembly as heretofore described and includes placing the repaired high voltage power supply unit in a heating oven as heretofore and hereinafter described and evacuating the heating oven to below 10 Torr and preferably below 1 Torr and backfilling the heating oven with an inert dry gas such as nitrogen having a dew point below 5° C.

The preferred method for reconditioning a previously repaired unit processed in accordance with the invention or a unit which has had the embedded moisture previously removed is to use a temperature of about 70° C. instead of 80° C. and continue removing moisture under vacuum until the rate of moisture removal drops to a rate of 5 milligrams/minute and preferably 0.4 milligrams/minute by a cold trap maintained at or below minus 70° C. Preferably the rate of moisture removal is measured by a mass spectrometer or a metallized ceramic hygrometer. The rate of moisture removal should not be allowed to drop as low as 0.2 milligram per minute at 70° C. due to the possibility of removing excessive quantities of plasticizers and impregnating oils from the heterogenous assortment of electronic components in the high voltage power supply.

Once the rate of desorption of moisture reaches about 0.4 milligrams per minute at 70° C. or 2.0 mg/minute at 85° C. the heating oven should be opened with a continuing flow of dry inert gas. The sealing surface of the cold plate of the corresponding FCR APG-68 housing should be secured to the O-ring in a groove in the pressure vessel to seal it against the cold plate of the high voltage high frequency power supply unit while the temperature of the high voltage power supply is above 40° C. and preferably above 50° C. The DMT (dual mode transmitter) of the FCR APG-68 tactical radar unit should then be sealed or preferably backfilled with sulfur hexafluoride through its Schrader valve.

In a further application and embodiment of the invention recently manufactured, remanufactured or repaired units can be treated to remove moisture from replacement or repaired components as well as ambient moisture introduced during the repair of tactical radar units. In new units or units that have not been repeatedly exposed to moisture during repair or have replacement components not known holding adsorbing or absorbing moisture a moisture removal process may be employed after the radar transmitter has been sealed within its pressure vessel.

In this embodiment of the invention the Schrader valve or the pressure relief valve and preferably both the Schrader valve and the nearby pressure relief valve are removed from the pressure vessel. Removal of both the Schrader valve and the nearby pressure relief valve is sufficient to permit sufficient conductance for the removal of surface moisture when the tactical radar unit is treated in accordance with the invention in a process chamber at a temperature of about 70 to 75° C. for a period of about four hours. Removal of only one valve limits conductance and necessitates additional considerations of time and temperature.

An example of the use of this process is the removal of surface moisture absorbed from the atmosphere during component replacement and repair operations or for newly manufactured units. When possible, it is convenient to remove moisture from a power supply of a radar transmitter after the latter has been sealed within its pressure vessel. The removal of moisture proceeds at a useful rate, however, only when there is appreciable conductance between the electronic components inside the pressure vessel and the evacuated space surrounding it. The very limited conductance available through an open Schrader valve is generally insufficient to permit removal of even the relatively small amount of moisture adsorbed during servicing within a period of time of a few hours. Therefore, a useful practice is to remove the pneumatic valve from the valve port which holds a valve such as a Schrader valve and the nearby pressure relief valve from the pressure vessel. The conductance through the resulting orifices in the wall of the pressure vessel is sufficient to permit removal of the surface moisture in a period of less than four hours at a temperature of 70 to 75° C.

In newly manufactured units or in units that have been previously processed in accordance with the invention and after a radar transmitter has been again serviced, the electronics are positioned within the pressure vessel, which is sealed by an O-ring. This sealing is conveniently accomplished while the transmitter is at room temperature. The Schrader valve communicating with the interior of the pressure vessel is then removed, as is the nearby pressure relief valve. The assembly is then placed in a process chamber. The chamber is maintained at a temperature of 70° C. to 75° C. The gas within the chamber at this point is a mixture of the nitrogen with which the chamber was most recently backfilled and air that has entered through the open chamber door. After closing and sealing the door of the chamber, a blower may be energized to increase the rate at which the temperature of the radar transmitter approaches the temperature of the chamber.

When the transmitter approaches the temperature of the chamber to within a few degrees, the blower, if employed, is deenergized and the chamber evacuated. A period of 30 minutes of heating by circulated air is normally sufficient. The temperature of the transmitter may be measured, but since transmitters heat up at a reproducible rate this is not required. As the chamber is evacuated, air diffuses from the interior of the pressure vessel to the chamber, through the orifices normally occupied by the Schrader valve and the pressure relief valve, at a rate such that the pressure in the vessel is only slightly greater than that in the chamber itself. The chamber pressure is optimally reduced to a pressure below 100 milliTorr and maintained there for two to three hours. Exposure for as much as four hours will not remove a very large proportion of the deeply embedded moisture that the electronic components may contain, but three hours will result in very complete removal of the moisture absorbed during the recent repair procedures.

In the event the repair processing involved immersion in an insulating fluid during high voltage testing, and if the removal of such fluid, for example Fluorinert™ 770, has been incomplete, this fluid will also be removed by evaporation and diffusion. To protect the oil of any mechanical vacuum pump employed to produce the vacuum, it is desirable to interpose a cold trap operating at or below −40° C. between the chamber and said vacuum pump. It is good practice, after some minutes, for example half an hour, after the pressure in the chamber has fallen below 100 milliTorr, to close a valve between the chamber and the vacuum pumping system and observe or record the rate at which the pressure in the chamber increases over a period of a few minutes. A pressure rising at a rate less than 100 milliTorr per minute indicates that the vacuum within the pressure vessel itself has fallen to an acceptably low value. At the end of the several hours of evacuation at temperature, the chamber and the pressure vessel are backfilled to atmospheric pressure with dry nitrogen gas.

The chamber door is opened and the Schrader valve or other pneumatic valve of the Schrader type and the pressure relief valve are reinstalled while the radar transmitter is still hot and full of dry nitrogen. The subsequent evacuation of the pressure vessel through the Schrader valve prior to the vessel's being filled with sulfur hexafluoride need not be as complete as if the vessel had been filled with ambient air containing moisture.

The advantages and unobvious aspects of the invention will be further discussed with reference to the Drawings and Detailed Description of the Invention including Best Mode.

BRIEF DESCRIPTION OF THE DRAWINGS

The invention will be further described in reference to disclosure of the best mode in conjunction with the accompanying drawings which for ease of reference and understanding will include state of the art military aircraft and the FCR APG-68 advanced pulse Doppler radar as a background for understanding the method of the invention for reconditioning the FCR APG-68 tactical radar unit to remove embedded moisture in which.

DETAILED DESCRIPTION OF THE INVENTION INCLUDING BEST MODE

This invention pertains to the removal of moisture from recently manufactured, remanufactured or repaired units as well as older units that have been repeatedly repaired and require the removal of deeply embedded moisture and absorbed moisture absorbed from the atmosphere during repair from the components associated with the high voltage power supply sections of airborne FCR APG-68 tactical radar transmitters. The moisture is removed to a degree at which subsequent changes in temperature encountered by high performance military aircraft will not result in condensation of water in the high voltage high frequency power supply in the sealed pressure vessels of such Fire Control Radar (FCR) APG-68 tactical radar units.

Figure 1:
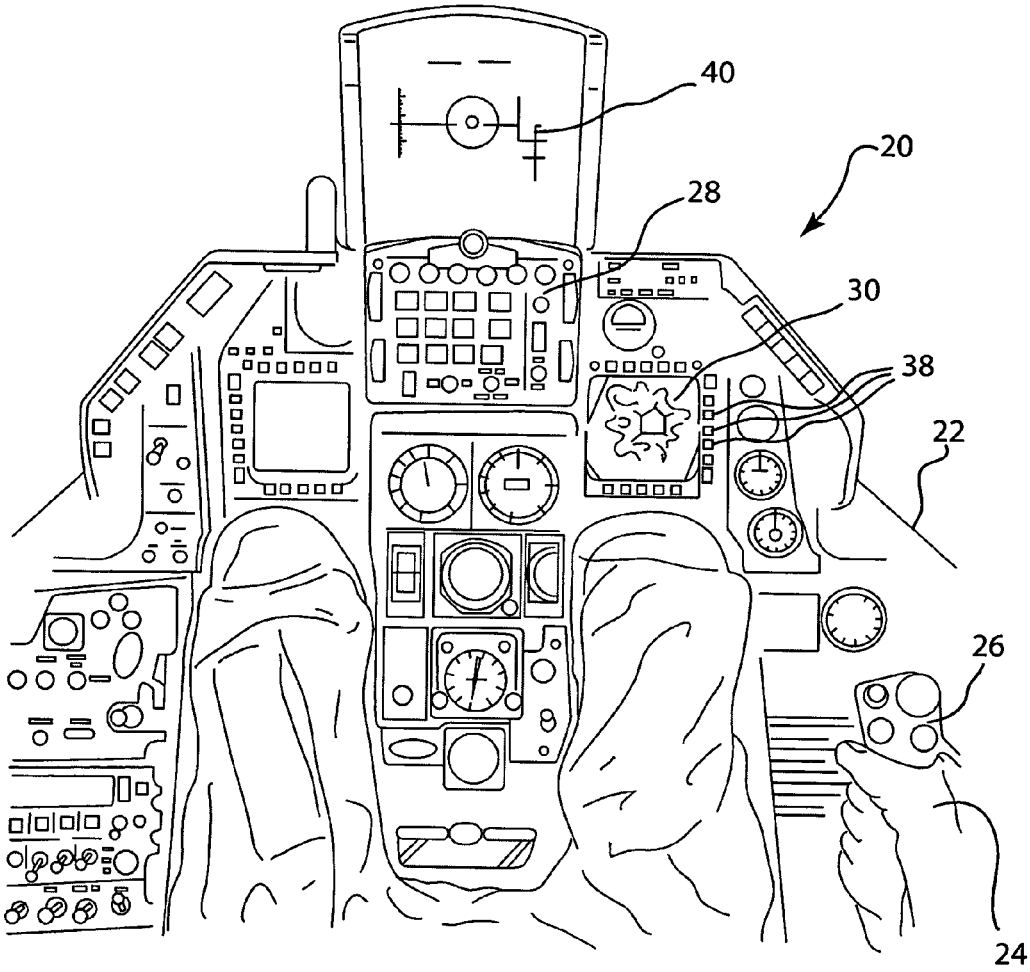
FIG. 1 ( PRIOR ART )
FIG. 1 is a front view cockpit of a state of the art military fighter aircraft having a Fire Control Radar (FCR) APG-68 display.

Referring now to FIG. 1 a cockpit 20 of a state of the art military aircraft 22 is illustrated. The cockpit includes switches and aviation instruments for controlling the flight altitude, altitude and speed of the aircraft which is controlled by the pilot 24 through a control stick 26 and rudder petals (not shown). An avionics panel 28 is provided together with a Fire Control Radar (FCR) APG-68 display screen 30.

The FCR APG-68 display 30 and its associated line replaceable units of a radar antenna 32 (FIG. 2) and FCR APG-68 tactical radar dual mode transmitter 34 are vital to the operation and mission of advanced fighter military aircraft. The FCR APG-68 tactical radar dual mode transmitter together with the associated common radar processor and modular receiver/exciter collectively referred to as aircraft computers (not shown) are typically located in the nose 36 of the military aircraft 22 provide vital data to FCR APG-68 display screen 30.

The vital data displayed on FCR APG-68 display screen 30 includes air, ground and sea target modes for target acquisition data and whether the target is using radar jamming techniques as well as range while searching modes, target histories, target tracking, situational awareness data as to target distances, range while searching capabilities; tracking while scanning, velocity search capabilities, air combat maneuvering capabilities, direction control of the radar, ground, air and sea target modes, ground mapping, ground moving target modes as well as additional capabilities and facilities that can be accessed through buttons 38 disposed around the perimeter of the FCR APG-68 display screen 30. In order for display screen 30 which is generally coupled to heads up display (HUD) 40 to operate properly in supplying vital data the FCR APG-68 tactical radar dual mode transmitter 34 must be providing correct and reliable data to the aircraft computers.

The FCR APG-68 tactical radar dual mode transmitter 34 is a line replaceable unit that in many instances has failed in operation. In addition the FCR APG-68 tactical radar dual mode transmitter 34 has experienced an ever decreasing mean time between failure (MTBF) after it has been repaired. Much of the FCR APG-68 tactical radar dual mode transmitter (DMT) is housed in a sealed aluminum high voltage pressure vessel 42 (FIG. 3) containing high frequency electronic assemblies and high voltage power supplies. The dual mode transmitter (DMT) 34 includes protective shrouds 44. The high voltage pressure vessel is sealed by bolts 46 that seal the cold plate 50 to the lower high voltage high frequency power supply housing or pressure vessel 42.

Figure 3:
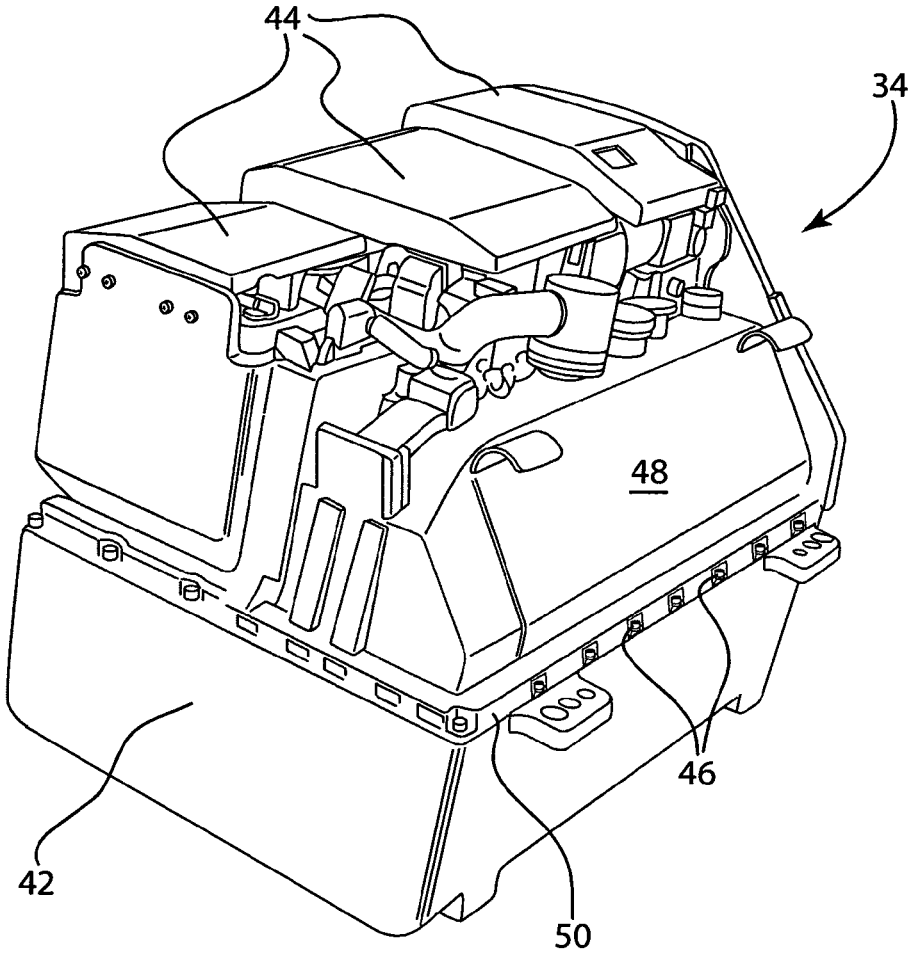
FIG. 3 ( PRIOR ART )
FIG. 3 is a perspective view of a state of the art FCR APG-68 tactical radar unit as removed from a state of the art military fighter aircraft.
Figure 4:
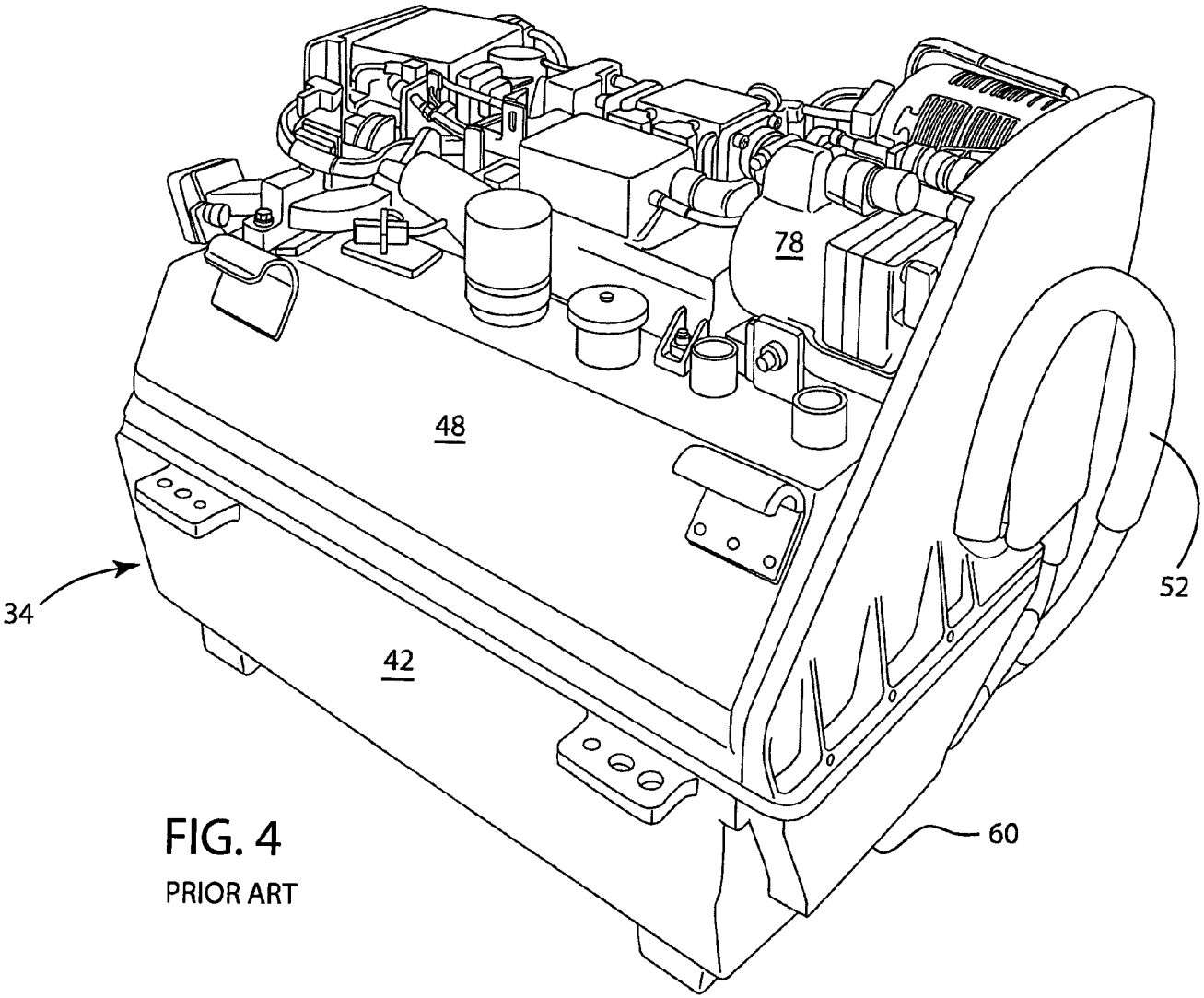
FIG. 4 PRIOR ART
FIG. 4 is a perspective view of the FCR APG-68 tactical radar unit of FIG. 3 with portions of the shroud removed and with a pneumatic fill valve and pressure relief valve shown removed and exploded with an actuator used to open the Schrader valve during a final evacuation and filling with $SF_6$.
Figure 5:
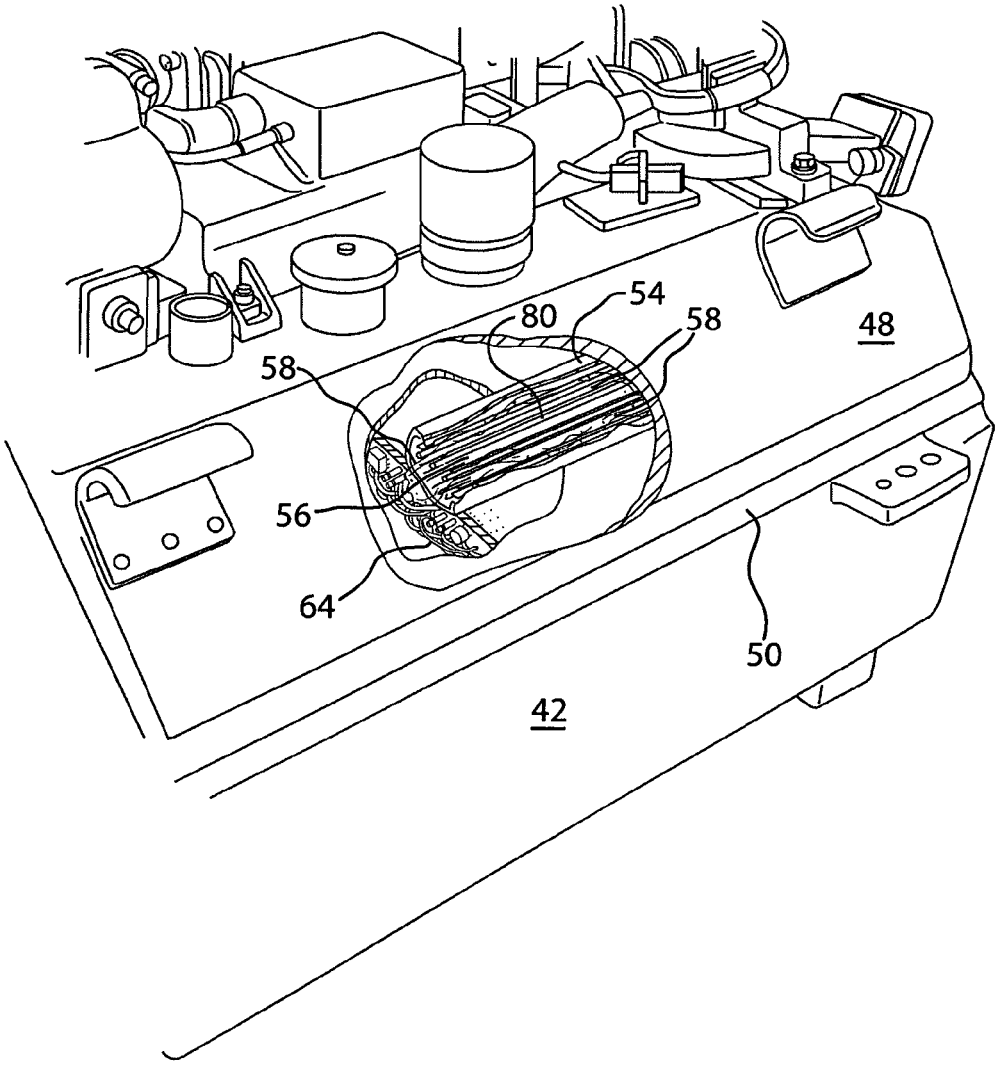
FIG. 5 ( PRIOR ART )
FIG. 5 is a perspective view of the FCR APG-68 tactical radar unit similar to FIG. 4 with a portion cut open to illustrate various components.
Figure 6:
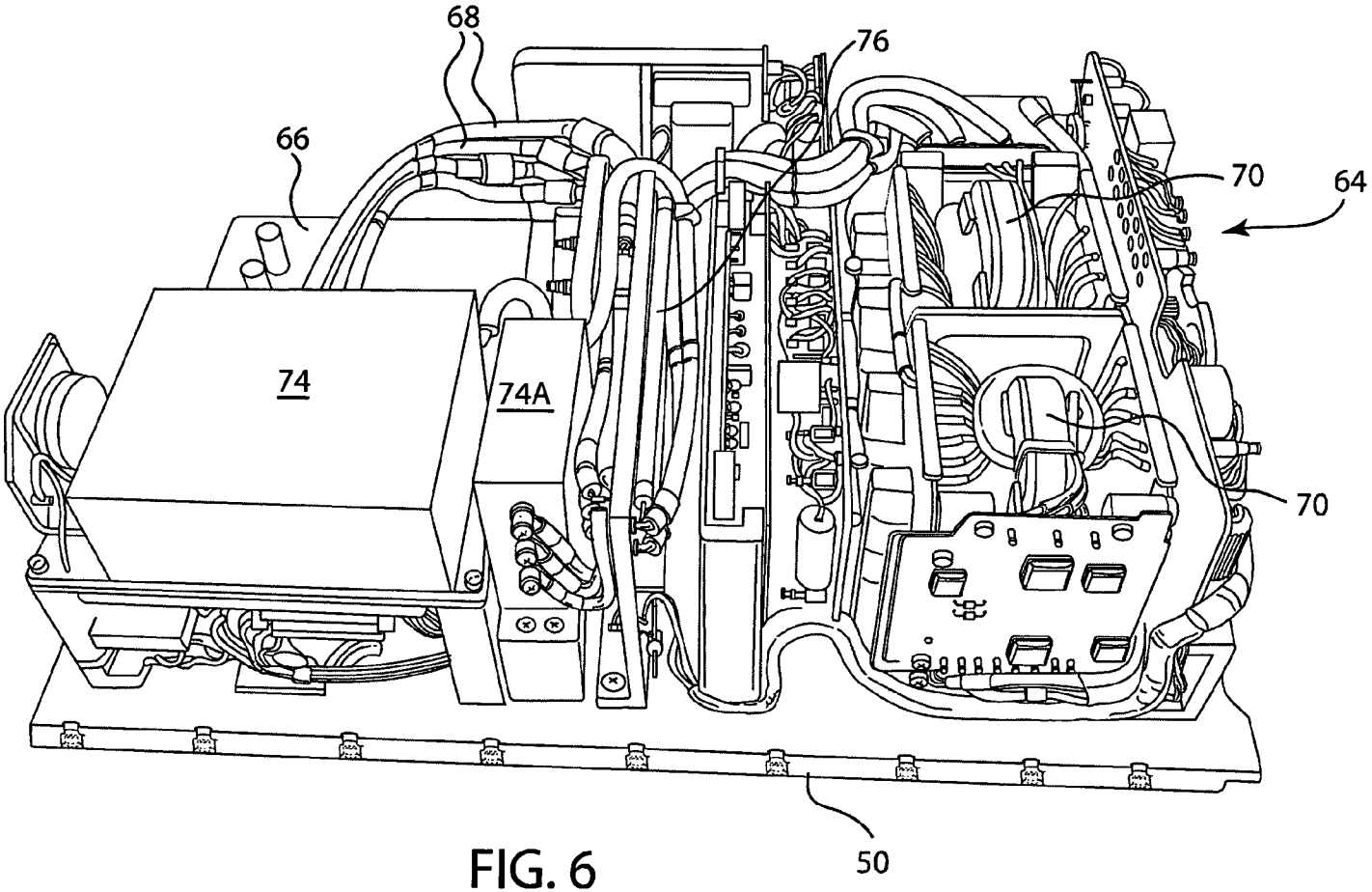
FIG. 6 ( PRIOR ART )
FIG. 6 is an inverted perspective view of the cold plate of a high voltage power supply assembly removed from a FCR APG-68 tactical radar unit illustrating the heterogenous collection of mounted electronic components.

Referring now to FIGS. 4, 5 and 6 the FCR APG-68 dual mode transmitter 34 includes a cooling hose 52 for supplying Coolanol™ 25R to a traveling wave tube (TWT) 54 (FIG. 5). Coolanol™ 25R 56 circulates around cooling fins 58 to keep TWT 54 within operating temperature parameters. A cooling unit inlet 60 (FIG. 4) is provided to cool air cooled cold plate 50 (FIG. 6). Cold plate 50 supports the high voltage high frequency power supply 64 (FIG. 6) which is supported upside down (FIG. 5) in lower high voltage high frequency power supply housing 42 and sealed in an atmosphere of sulfur hexafluoride gas by an O-ring and bolts 46 (FIG. 3).

Figure 2:
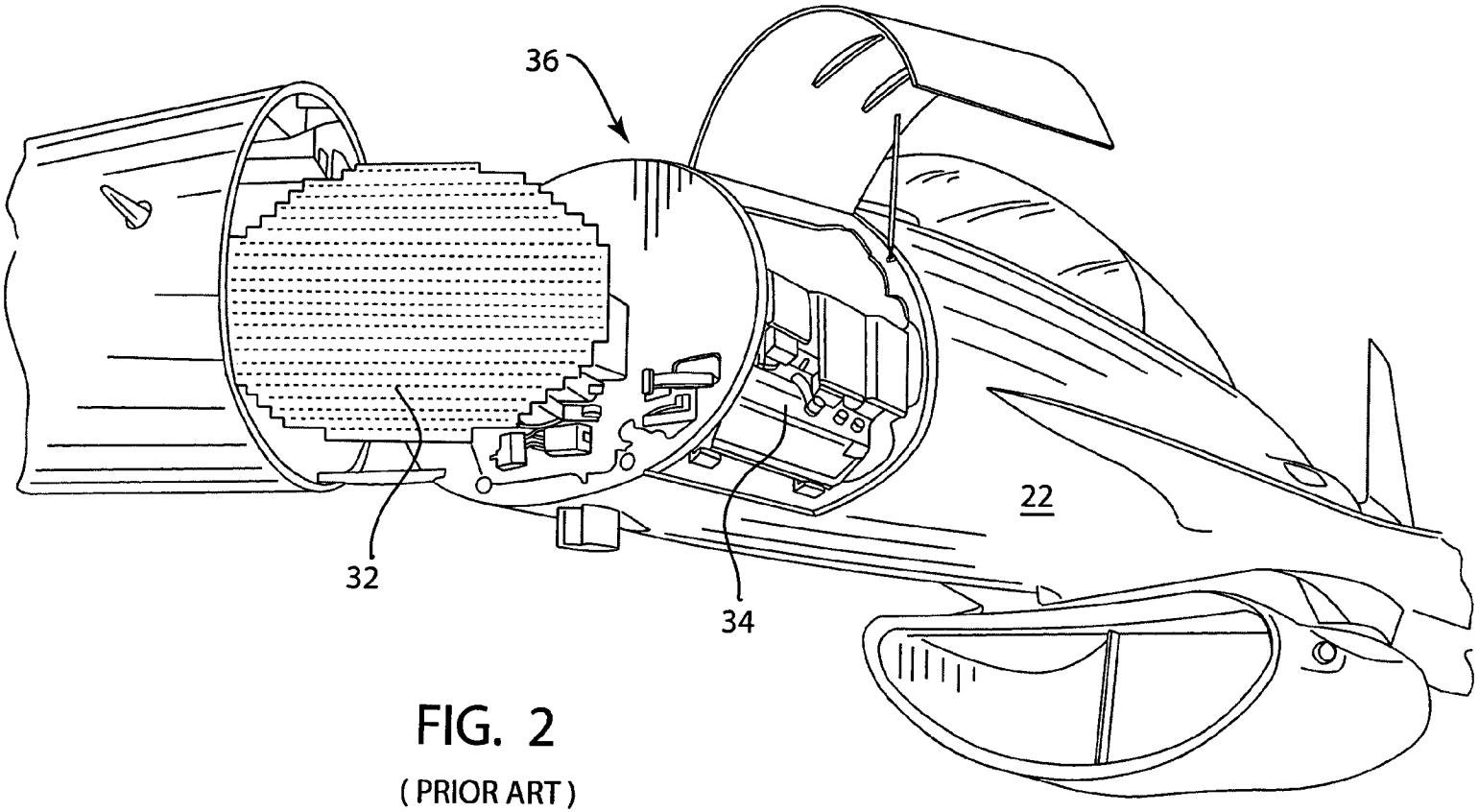
FIG. 2 ( PRIOR ART )
FIG. 2 is a perspective view of a state of the art military fighter aircraft partly in section illustrating the location of the (FCR) APG-68 tactical radar unit and FCR APG-68 antenna with inertial measurement unit.

Referring now to FIGS. 2, 3 and 6 the FCR APG-68 tactical radar dual mode transmitter 34 includes the high voltage high frequency power supply 64 and accompanying RF modules 66, high voltage wiring 68, transformers 70, voltage resistors 76 and associated electronics that are enclosed in the pressure vessel 42. A traveling wave tube (TWT) 54, and associated cooling systems as heretofore discussed operate to remove heat from the TWT and from the associated electronics of the power supply 64. The cooling systems include the air-cooled cold plate 50 on which the electronic and power supply components are mounted (FIG. 5 and FIG. 6), an air-to-liquid heat exchanger, Coolanol™ 25R heat transfer fluid, a circulating pump 78 (FIG. 4) and the cooling fins 58 and cooling tubes 80 within the TWT 54. Air cooling inlet 60 together with cold plate 50 insure a rapid cooling of high voltage high frequency power supply 64 when military aircraft 22 goes from high temperature ground conditions resulting in a diffusion of the embedded and absorbed moisture to high altitude low temperature flight conditions causing rapid condensation of diffused embedded moisture and absorbed moisture in the high frequency power supply 64 resulting in condensation of the formerly embedded and absorbed moisture and arcing, partial discharges and failure of the FCR APG-68 tactical radar unit.

The rated power input to the TWT is 2370 watts at a duty cycle of 42%, and this is in addition to filament, grid and ion pump power. A circulating pump circulates the Coolanol™ at the rate of 2 gallons per minute through the heat exchanger, the TWT and associated tubing. The Coolanol™ serves as both a medium for heat transfer and as a dielectric insulating fluid, being subjected to a dielectric stress of 25,000 volts. A spring-loaded accumulator maintains its pressure positive at about 7 psig at the entrance to the pump through changes in temperature and altitude. The performance of the radar system is critically dependent upon the removal of heat and upon the surfaces of the TWT not being allowed to exceed 160° C. Hot spots would cause degradation of the heat transfer fluid, resulting eventually to the buildup of solids, sludge and the reduction in both heat transfer coefficients on the surfaces of the TWT and in the rate of circulation of the fluid, and failure of the radar system. Such failures do occur. A failure of one of the various components of the electronic system can cause such failures.

However a previously unrecognized cause of the failure of the cooling system is malfunction of the high voltage high frequency power supply 64 sealed in the pressure vessel 42 due to an accumulation of moisture in one or more of the components of the high voltage high frequency power supply. Band edge oscillations, RF drive-induced oscillations, noise, and waveform distortion can all result from malfunctions in the electronic components in the pressure vessel.

Moisture in the high voltage high frequency power supply 64 comes from the time of original manufacture as well as moisture absorbed by the electric components from the atmospheres of the shops in which transmitters which have failed in service are repaired. Repair involves opening up the pressure vessel in which the components of the high voltage electronic section remain sealed while in service and when repaired are generally exposed to shop atmosphere for periods of time, usually in terms of days. The service life of a FCR APG-68 tactical radar transmitter is measured in decades while in practice it is repaired over and over again. Conventional systems for drying the high voltage components of such FCR APG-68 tactical radar transmitters employ evacuation through the relatively tiny passages in the Schrader valve in the pressure vessel which is subsequently backfilled with sulfur hexafluoride. The procedure has resulted in the accumulation of moisture over multiple cycles of repair and service that has become embedded in the high voltage high frequency power supply only to be released in the pressure vessel and the $SF_6$ ambient gas by high ground temperatures followed by rapid changes in temperature encountered in flight operations.

The invention provides a method for removing embedded moisture over multiple cycles of repair as well as absorbed moisture which is acquired whenever the high voltage high frequency power supply is opened up or repaired. The invention in its best mode and preferred embodiments for repeatedly repaired units or units that have been repaired or reconstructed with components that are known to adsorb or absorb moisture includes the following steps:

(a) Disassembling a FCR APG-68 tactical radar unit and placing the high voltage high frequency power supply in a vacuum chamber or placing a high voltage high frequency power supply from a FCR APG-68 tactical radar unit in a vacuum chamber whose walls are heated and controlled at temperatures in the range of 40 to 105° C., preferably at 70 to 85° C., which vacuum chamber has a circulating fan and with a sliding shelf and loading door at one end;

(b) Employing a vacuum pumping system capable of reducing the partial pressure of permanent gases in the vacuum chamber below 10 Torr and preferably below 100 milliTorr;

(c) Utilizing a cold trap operated at or below 0° C. and preferably at or below minus 70° C. between the vacuum pumping system and the vacuum chamber;

(d) Removing moisture from the high voltage high frequency power supply until the rate of moisture desorption has fallen to below about 2 mg/minute at about 60° C. or 5 mg/minute at about 70° C. or 25 mg/minute at 85° C. and preferably below 0.1 mg/minute at about 60° C. or about 0.4 mg/minute at 70° C. or about 2 mg/minute at about 85° C. or until the high voltage high frequency power supply has been in the vacuum chamber for at least 4 hours or operating the evacuation chamber until the rate of moisture removal is less than about 20 milligrams per minute at about 70° C. or for at least 2 hours;

The following steps are optional but are in accordance with the preferred embodiment and include the additional steps of:

(e) Providing a vacuum valve disposed between the cold trap and the vacuum chamber for the purpose of periodically isolating the chamber from the cold trap;

(f) Employing measurement means communicating with the atmosphere within the vacuum chamber, consisting as a minimum of a pressure gauge such as a thermocouple gauge capable of indicating pressures down to 1 milliTorr, and preferably including moisture instrumentation capable of displaying dew point down to −70° C. or moisture concentration in parts per million;

(g) Utilizing temperature measurement means that can be clamped to a massive portion of the electronic assembly for the purpose of indicating the temperature of that assembly;

(h) Removing the high voltage high frequency power supply while still warm at 35 to 40 degrees C. and either sealing the high voltage high frequency power supply in a gas impervious package and evacuating the package or reassembling the high voltage high frequency power supply in the sealed high pressure vessel and backfilling the sealed high pressure vessel with a dry gas within preferably 5 minutes to about 2 hours after it has been processed in the vacuum chamber;

(i) Backfilling the vacuum chamber with a dry substantially inert gas having a dew point below 5° C. such as nitrogen or carbon dioxide or an inert gas such as helium, argon or neon while the high voltage high frequency power supply is being dried;

(j) Employing a temperature of about 80° C. for removing embedded moisture from a high voltage high frequency power supply that has been previously repaired but not treated in accordance with the method of the invention;

(k) Evacuating through the cold trap;

(l) Closing a valve between the cold trap and vacuum chamber and observing the rate at which the pressure in the chamber or moisture concentration builds up over a period of one minute and recording the pressure or moisture concentration; and (m) In the preferred embodiment and best mode providing a space between the cold plate of the high voltage high frequency power supply and the upper edge of the pressure vessel all around the periphery of the cold plate to provide a path of high conductance between the interior of the pressure vessel and the surfaces of the high voltage high frequency power supply.

The method of the invention also encompasses drying a high voltage high frequency power supply that has just been repaired by utilizing the steps of:

(1) In the preferred embodiment and best mode providing a space all around of at least one-half inch between the cold plate of the high voltage high frequency power supply and the pressure vessel with its O-ring seal in place below and mounting the two parts of the repaired transmitter assembly on a sliding shelf of the pressure chamber;

(2) Using a sliding shelf in the pressure chamber and pushing the sliding shelf with the cold plate assembly and pressure vessel into the chamber, closing and sealing the door;

(3) Preferably evacuating the chamber to a pressure below 10 Torr and preferably below 1 Torr;

(4) Preferably backfilling the chamber with an inert dry gas, normally nitrogen, but equally effective, although more expensive such gases as helium, argon, neon, and carbon dioxide or air whose dew point is below 5° C.;

(5) Starting a circulating fan to accelerate the heating of the assembly;

(6) Stopping the circulating fan as the temperature of the load approaches the chosen temperature (normally 70° C. after a single repair);

(6a) A temperature of 80° C. is normally employed when removing moisture from a high voltage high frequency power supply that has been in service for years without benefit of this drying treatment after each servicing;

(Temperatures as low as 40° C. can be employed, but such low temperatures result in inconveniently long drying times.) Temperatures up to 105'C may be employed but run the risk of damaging electronic components and overdrying insulation;

(7) Evacuating the chamber through the cold trap;

(8) Preferably periodically closing the valve between the cold trap and the vacuum chamber and observing the rate at which the pressure in the chamber or the moisture concentration within the chamber rises over a period of approximately one minute by recording the pressure or the moisture concentration at the beginning and end of a one minute period;

(9) Preferably converting the pressure rise or the concentration of moisture rise over a one minute period to a moisture desorption rate;

(10) Terminating the drying after a period of time sufficient to cause the rate at which moisture is being desorbed from the high voltage high frequency power supply of a unit which has had the embedded moisture previously removed to drop to a rate of 5 mg per minute and preferably 0.4 mg per minute but not as low as 1 mg/minute at about 85° C. to 0.2 mg/minute at 70° C.;

(11) Backfilling the chamber with a dry inert gas, preferably nitrogen, but equally effective, although more expensive, such gases as helium, argon, neon, and carbon dioxide or air whose dew point is below 5° C.;

(12) Opening the door of the chamber but allowing the flow of dry inert gas to continue, blanketing the load, withdrawing the high voltage high frequency power supply from the pressure vessel and at least partially from the chamber by pulling the sliding shelf forward out of the chamber while the high voltage high frequency power supply is still warm and preferably above 50° C.;

(13) Lowering the cold plate bearing its electronics and high voltage power supply down into the lower high voltage high frequency power supply housing 42 so that its electronic and power supply assemblies project down into the pressure vessel and its sealing surface seals to the O-ring of the pressure vessel while the load is still at a temperature above 40° C.

and preferably above 50° C. (This assures that the atmosphere within the pressure vessel at this point in time is at a very low relative humidity.); and

(14) Evacuating the pressure vessel through its Schrader valve and backfilling it with sulfur hexafluoride.

It has been recently found the process of the invention is applicable to newly manufactured units as well as newly assembled units that have not accumulated moisture in their components as a result of repeated repairs or exposure of their components to ambient atmospheres containing high levels of moisture. In such cases moisture which has not become embedded or adsorbed in such units can be removed by removing either the Schrader valve or the pressure relief valve and preferably both from the assembled radar transmitter unit and sealing the cold plate 50 (FIG. 6) to the pressure vessel 42 (FIG. 3) by placing the O-ring in place and securing the cold plate and pressure vessel together with bolts 46 (FIG. 3) in accordance with the prior art procedures and methods. Optionally the other components of the high voltage high frequency power supply may also be assembled and attached to the cold plate such as the TWT, heat exchanger, hoses 52 (FIG. 4) circulating pump (FIG. 4) and covers 44 and 48 (FIG. 3). Thereafter the following steps are utilized:

(1) Removing the pressure relief valve 47 from the pressure relief port (FIG. 4) and the Schrader valve 49 with its cap 51 (FIG. 4) from the fill port at the end of the pressure vessel 42, thus exposing orifices of approximately 5/16" and 1/4", respectively; (These orifices or ports provide sufficient conductance between the interior of the pressure vessel and the chamber to permit non-embedded moisture to be removed in about 2 hours to 24 hours and preferably three to four hours at a temperature of about 40° C. to 100° C. and preferably 75° C.);

(2) Placing the assembly on the sliding shelf, pushing the entire unit into the chamber at a preferred temperature of 70° C. to 85° C., closing and sealing the door;

(3) Operating the circulating fan until the temperature of DMT or unit reaches about 5° C. of the target temperature of 70° C. to 85° C., then stopping the fan and starting to evacuate the chamber through a cold trap maintained below −65° C.;

(4) After one hour of evacuation, checking to assure that the pressure in the chamber is below 750 milliTorr or within 10% of the target pressure. (A pressure greater than 750 milliTorr is an indication of malfunction of the equipment or gross leakage);

(5) After three to four hours of evacuation, backfilling the chamber with dry nitrogen gas;

(6) Opening the door of the chamber and pulling the sliding shelf out of the chamber;

(7) Reinserting immediately the pressure relief valve 47 (FIG. 4) and the Schrader valve 49 (FIG. 4) into the orifices from which they had been removed and screwing them in with the proper torques (At this point the high voltage high frequency power supply may optionally be removed from the sliding shelf and positioned on an adjacent supporting surface.);

(8) Applying a valve actuator 53 such as a Schrader valve-actuator (FIG. 4) to a valve 49 such as a Schrader valve, employing the valve-actuator to open the Schrader valve and evacuating the interior of the pressure vessel through the Schrader valve;

(9) After thirty minutes of evacuation, closing a valve in the evacuation line, then observing and noting the pressure between that valve and the Schrader valve;

(10) Observing the pressure again after two minutes. If the pressure in an assembly that has not previously been processed to remove embedded moisture has risen more than 100 milliTorr with respect to the pressure observed two minutes previously, the assembly should be rejected and subjected to a rigorous leak testing procedure, preferably involving a helium mass spectroscopic leak tester (Testing the pressure vessel for leakage with a helium leak tester while the pressure vessel is still under vacuum and before it is filled with sulfur hexafluoride is highly desirable even when the pressure rise observed in step number 10 above does not exceed 100 milliTorr.);

(11) Backfilling the pressure vessel through the Schrader valve with sulfur hexafluoride, closing the Schrader valve actuator and applying cap 51 (FIG. 4).

Not all of the foregoing steps and not necessarily in the order presented are necessary to implement the invention. The foregoing list of steps and their order are provided merely for the purposes of illustration and are not to be considered limiting unless limited in the claims.

Figure 13:
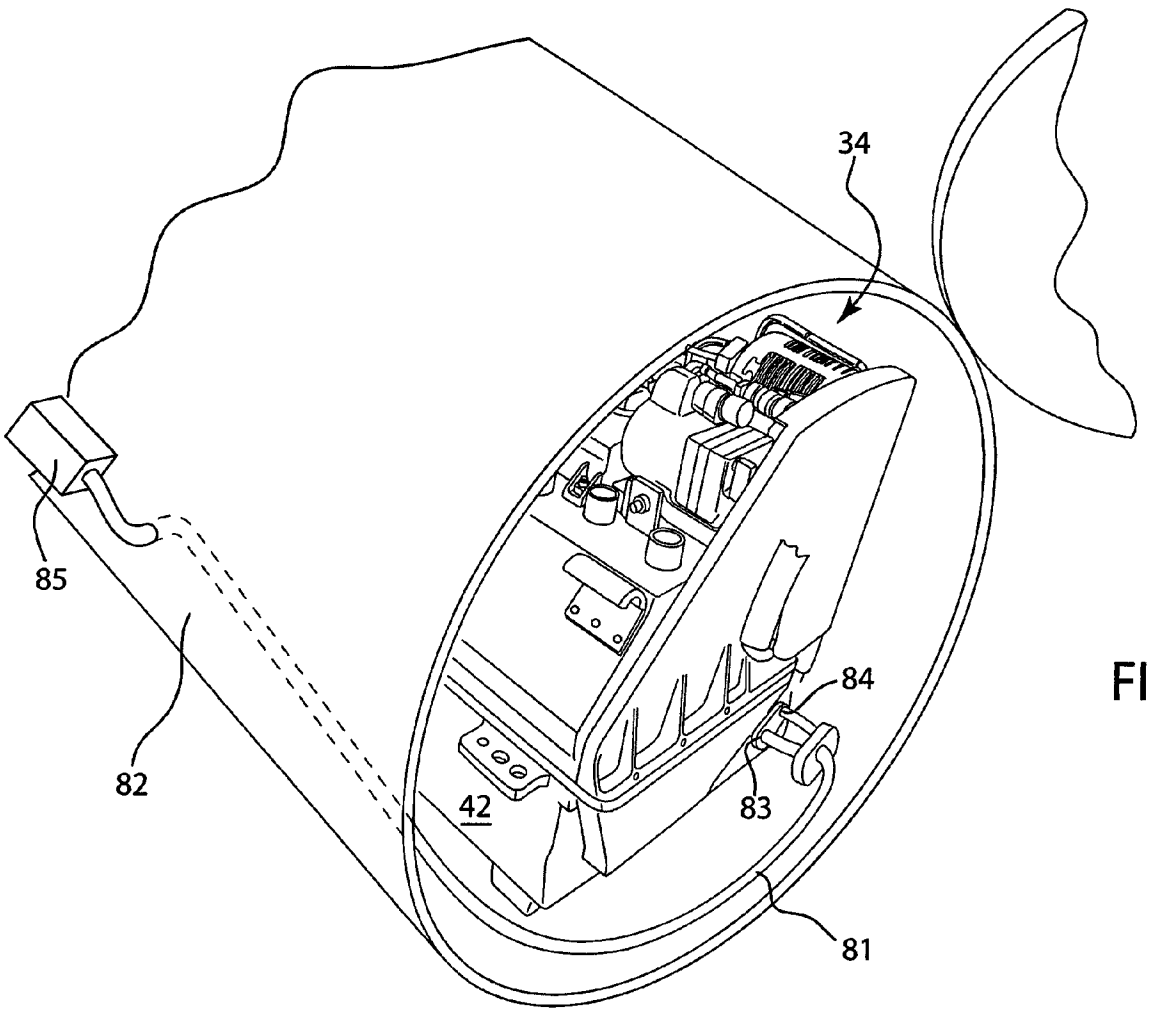
FIG. 13 is a perspective view of a heating oven having a vacuum connection for removing moisture from a newly manufactured or repaired FCR APG-68 tactical radar unit in accordance with an alternative embodiment of the novel method.

In a further alternative embodiment new units or units that have been recently treated to remove embedded moisture may be treated in a conventional heating oven. Referring now to FIG. 13 a conventional heating oven 82 is illustrated containing a new or recently treated dual mode transmitter 34. Dual mode transmitter 34 has had the pressure relief valve 47 (FIG. 4) removed from the pressure relief port 83 as well as a pneumatic valve such as a Schrader valve 49 removed from the fill port 84;

A vacuum line 81 is run from a vacuum pump or source 85 and connected to the pressure relief port 83 or the fill valve port 84 and preferably both as illustrated in FIG. 13. The vacuum pump or source 85 preferably includes a valve and a cold trap. The conventional heating oven 82 is then heated until the DMT or unit reaches a range of about 70° to 85° C. at which time vacuum pump or source 84 is operated at least below 10 Torr and preferably in the range of about 100 milliTorr to 750 milliTorr. The DMT 34 is then removed from the heating oven 82 and backfilled with sulfur hexafluoride.

In radar units that have been repeatedly repaired or that have had components replaced that are known to adsorb, absorb or retain moisture the preferred application of the invention involves separation of the components and desorption treatment for a period of time as previously discussed. The period of time required to cause the rate at which moisture is being desorbed from the electronic assembly to drop to a target value is preferably determined from the measurement of the pressure rise or change in moisture concentration over a period of one minute. However it will be understood that a standard period of drying time could be employed after it had been determined by measurements on a number of transmitters to be adequate at the temperature employed to cause the rate of moisture desorbing from the average load to fall to a value below that corresponding to 2 mg/minute or preferably 0.4 mg/minute at 70° C. but not as low as 0.2 mg/minute. At 70° C. the moisture content of a space is approximately 24 mg/cubic foot/Torr of vapor pressure of water and between 40° C. and 100° C. it remains 24±2 mg/cubic foot. The rate of evolution in mg/minute may be estimated from the rate of rise of pressure by multiplying the rate of rise of pressure in mTorr/minute by the volume of the chamber in cubic feet and by 0.024.

A suitable target rate for removal of embedded moisture from an FCR APG-68 tactical radar high voltage high frequency power supply at 70° C. is 0.4 mg/minute. When the rate of removal of moisture drops to this value still further drying is possible but risks the removal of excessive and undesirable quantities of plasticizers and impregnating oils.

Figure 7:
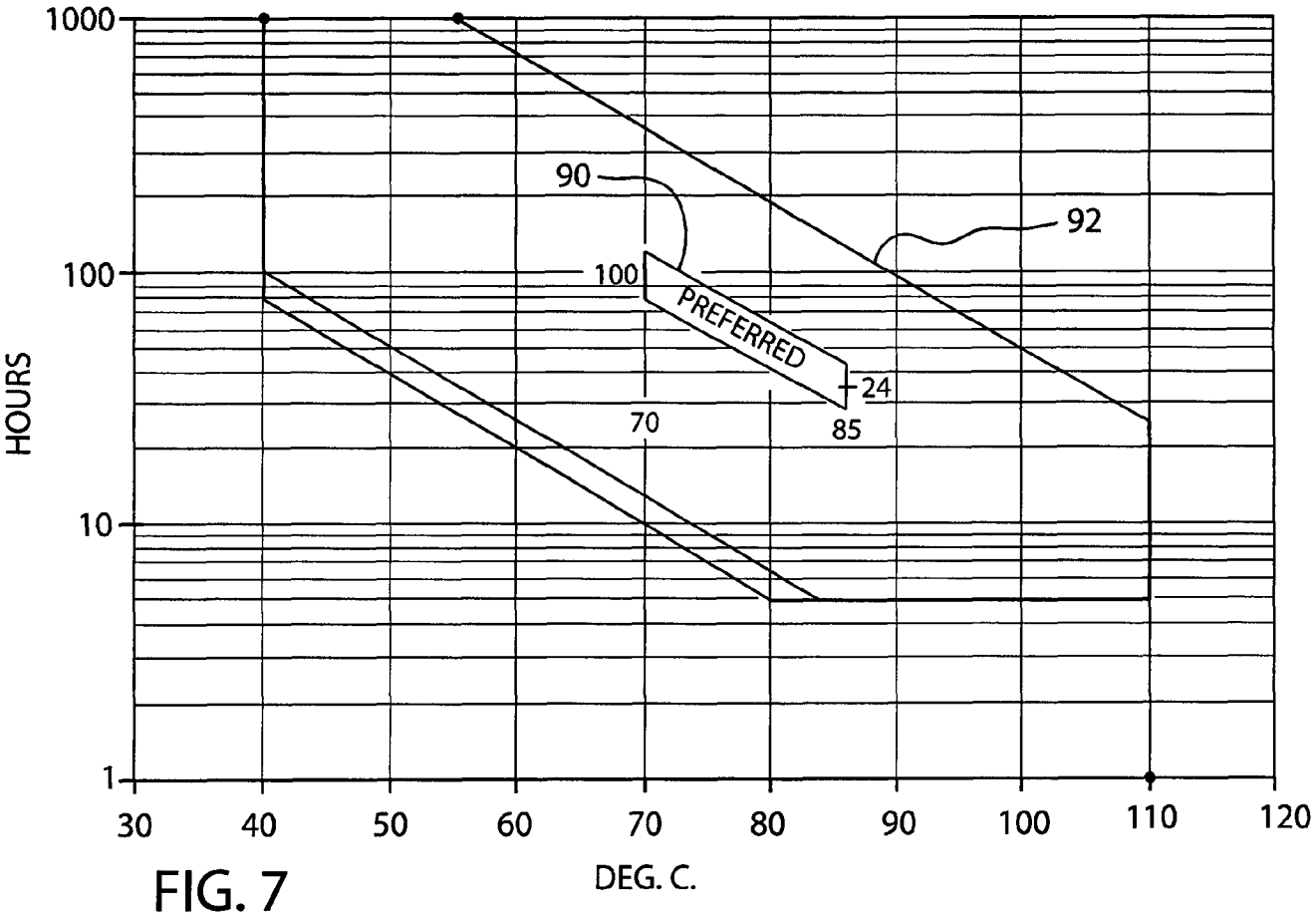
FIG. 7 is a graph illustrating the temperature and time parameters for removing deleterious embedded moisture and absorbed moisture from the heterogenous collection of electronic components of the high voltage power supply assembly of a FCR APG-68 tactical radar unit in accordance with the invention.

Referring now to FIG. 7 the preferred embodiment for drying high voltage high frequency power supply units from FCR APG-68 tactical radar dual mode transmitters is illustrated. The preferred temperature range is from about 70° C. to 85° C. for a period of from about 24 hours to about 100 hours as represented by preferred rectangular box 90 to remove embedded and absorbed moisture that is deleterious to the operational life of the FCR APG-68 tactical radar dual mode transmitters.

Line 92 represents atmospheric pressure indicating the invention may be practiced without utilizing a vacuum but at the expense of very long drying periods approaching 1,000 hours or more. Typically a vacuum of less than 0.1 Torr and preferably less than 5 Torr and in the preferred rectangular box 90 a vacuum of 100 to 200 milliTorr is utilized in accordance with the best mode and preferred embodiment of the invention.

The invention will be further described with reference to the following operative examples which are provided for the purpose of further illustrating the novel and unobvious aspects of the invention without limiting the invention except as many hereinafter be limited in the claims.

EXAMPLE 1

A high voltage high frequency power supply was removed from a FCR APG-68 tactical radar dual mode transmitter from a B1 bomber state of the art transmitter. The high voltage high frequency power supply was placed in an evacuation heating oven Model No. 1061 as available from Slack Associates, Inc. and heated to a temperature of about 85° C. and evacuated to a pressure of about 150 milliTorr for almost 4 days until the amount of water removed dropped to about 1 milligram per minute. A total of about 10.39 grams of water was removed.

Figure 8:
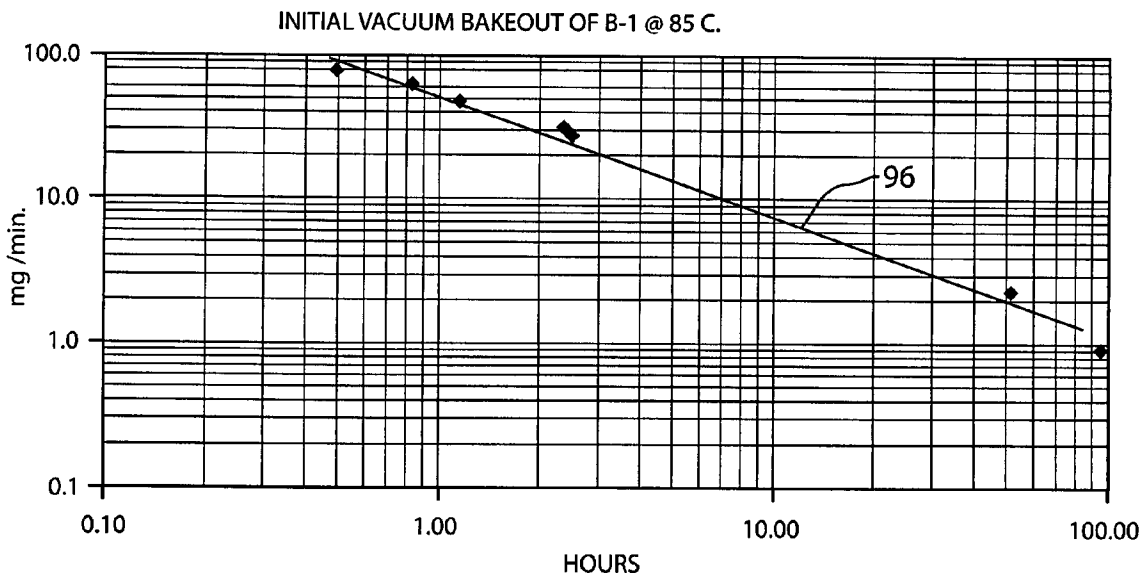
FIG. 8 is a data list and graph illustrating the rate of embedded moisture removed from a FCR APG-68 tactical radar unit removed from a high voltage high frequency power supply assembly from a B1 military bomber utilizing the method of the invention.

The data and graph illustrating the removal of moisture from the high voltage high frequency power supply from the FCR APG-68 tactical radar dual mode transmitter is illustrated in FIG. 8 illustrating a trendline 96 showing a rate of removal as a function of time on a log-log scale.

EXAMPLE 2

The previously dried high voltage high frequency power supply of Example 1 was then left for about three days to ambient atmosphere. The high voltage high frequency power supply unit was again placed in a Slack Associates, Inc. Model No. 1061 evacuation heating oven and dried at 85° C. at a pressure of about 65 milliTorr. After 2.37 hours water was still being removed from the high voltage high frequency power supply unit at a rate of about 7.9 mg/minute. After another 18 hours of additional drying the moisture rate of removal reached the 1.5 milligram per minute range. After a total of about 26 hours of vacuum drying a total of about 1.75 grams of water had been removed and the rate had fallen to about 1.3 mg of water per minute.

Figure 9:
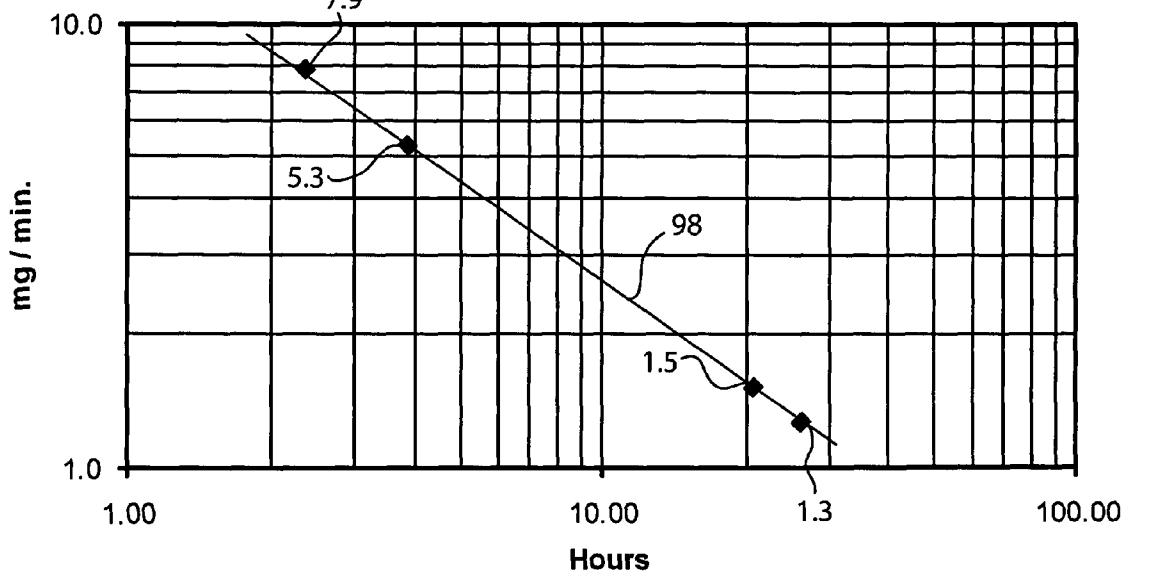
FIG. 9 is a data list and graph illustrating the rate of removal of absorbed moisture removed from the high voltage high frequency power supply of FIG. 8 after a first drying to remove embedded moisture and after about 3 days exposure to ambient atmosphere.

The data and graph illustrating the removal of moisture on a first redrying of the high voltage high frequency power supply from the FCR APG-68 tactical radar dual mode transmitter is illustrated in FIG. 9 illustrating a trendline 98 showing a rate of removal as a function of time on a log-log scale.

EXAMPLE 3

The same high voltage high frequency power supply of the FCR APG-68 tactical radar dual mode transmitter from the B1 bomber of Example 2 was left exposed to ambient atmosphere for about an additional three days. The high voltage high frequency power supply was placed in a Slack Associates, Inc. of Baltimore, Md. evacuation heating oven Model No. 1061 and evacuated to a pressure of about 75 milliTorr for about 6 hours at 85° C. After about 6.12 hours of vacuum drying the rate of moisture removal had fallen to about 2.6 milligrams of water per minute and an additional 1.47 grams of moisture had been removed.

Figure 10:
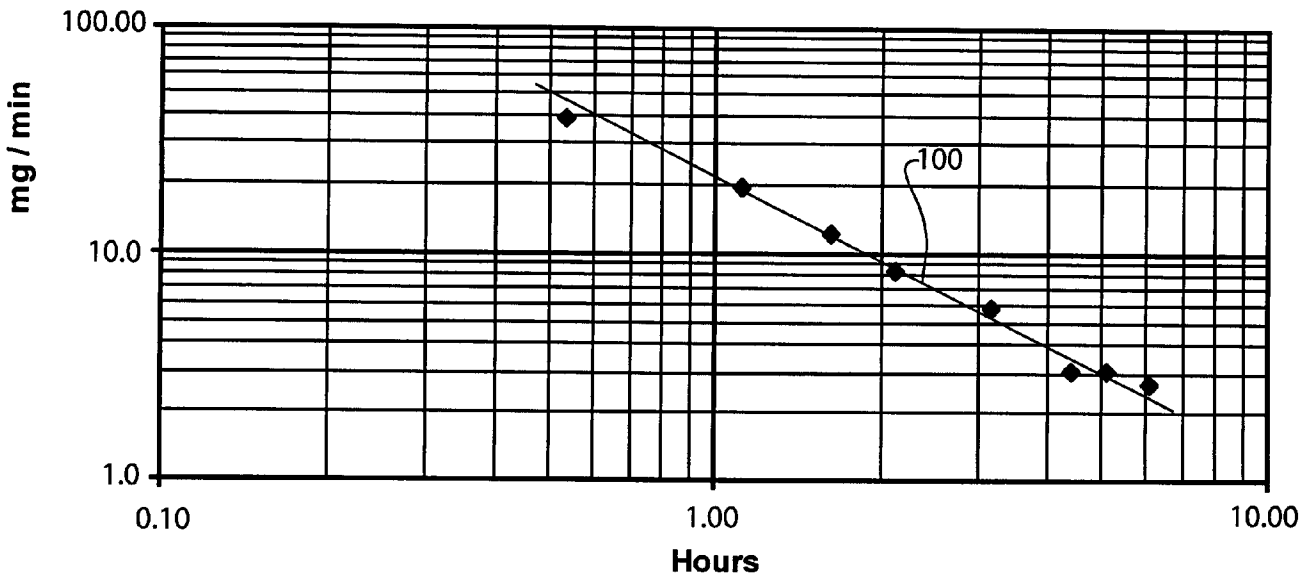
FIG. 10 is a data list and graph illustrating the rate of removal of absorbed moisture removed from the high voltage high frequency power supply of FIG. 9 after about an additional 3 days exposure to ambient atmosphere.

The data results and graph illustrating the second redrying removal of moisture from the high voltage high frequency power supply from the FCR APG-68 tactical radar dual mode transmitter is illustrated in FIG. 10 illustrating a trendline 100 showing a rate of removal as a function of time on a log-log scale.

EXAMPLE 4

The same high voltage high frequency power supply of the FCR APG-68 tactical radar dual mode transmitter from the B1 bomber of Example 3 was exposed to ambient atmosphere for about 7 additional days. The twice previously redried high voltage high frequency power supply was again placed in a Slack Associates, Inc. of Baltimore, Md. evacuation heating oven Model No. 1061 and evacuated to a pressure of about 800 milliTorr and heated to about 70° C. for about an additional 48 hours before the moisture rate of removal reached about 0.4 milligrams per minute. A total of about 2.93 grams of water was removed during the total drying time of 47.72 hours.

Figure 11:
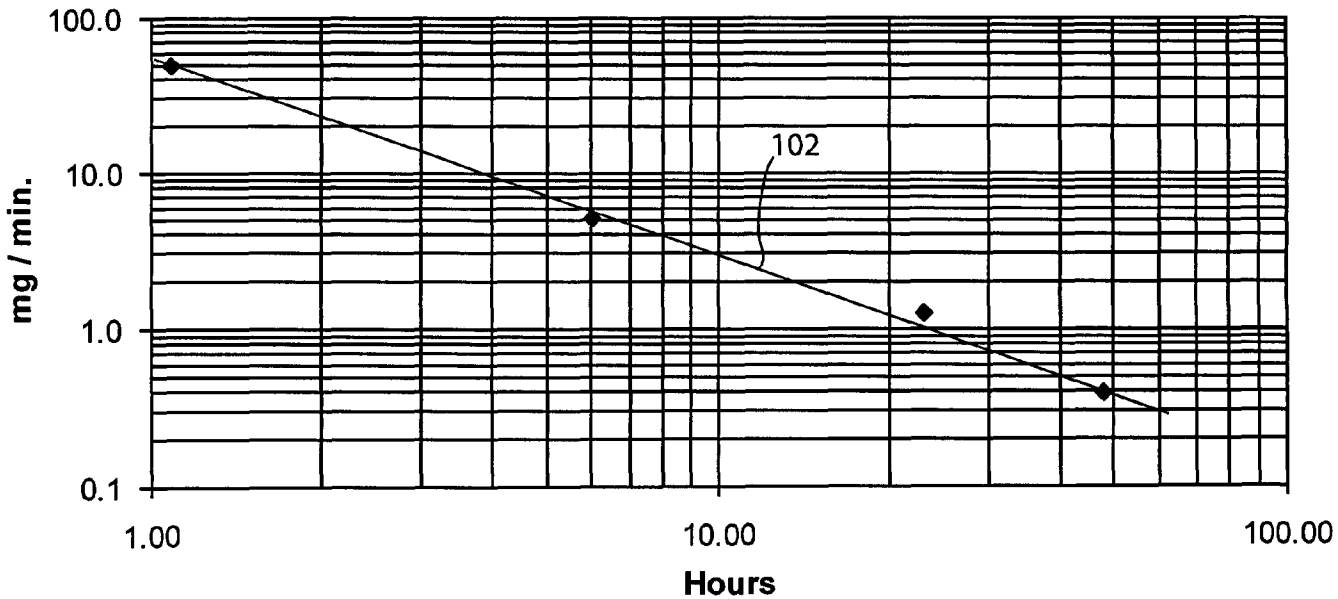
FIG. 11 is a data list and graph illustrating the rate of removal of absorbed moisture removed from the high voltage high frequency power supply of FIG. 10 after about an additional 7 days exposure to ambient atmosphere.

The data and graph illustrating the removal of moisture on the third redrying of the high voltage high frequency power supply from the FCR APG-68 tactical radar dual mode transmitter is illustrated in FIG. 11 illustrating a trendline 102 showing a rate of removal as a function of time on a log-log scale.

EXAMPLE 5

The same high voltage high frequency power supply of the FCR APG-68 tactical radar dual mode transmitter from the B1 bomber of Example 4 was exposed to ambient shop atmosphere for an additional 6 days. The thrice previously redried high voltage high frequency power supply was again placed in a Slack Associates, Inc. evacuation heating oven Model No. 1061 and evacuated to a pressure of about 100 to 300 milliTorr for about an additional 48 hours at about 60° C. It took 45.97 hours for the rate of removal of moisture to drop to approximately 0.2 mg/minute. A total of about 1.3 grams of water was removed in the fourth redrying procedure.

Figure 12:
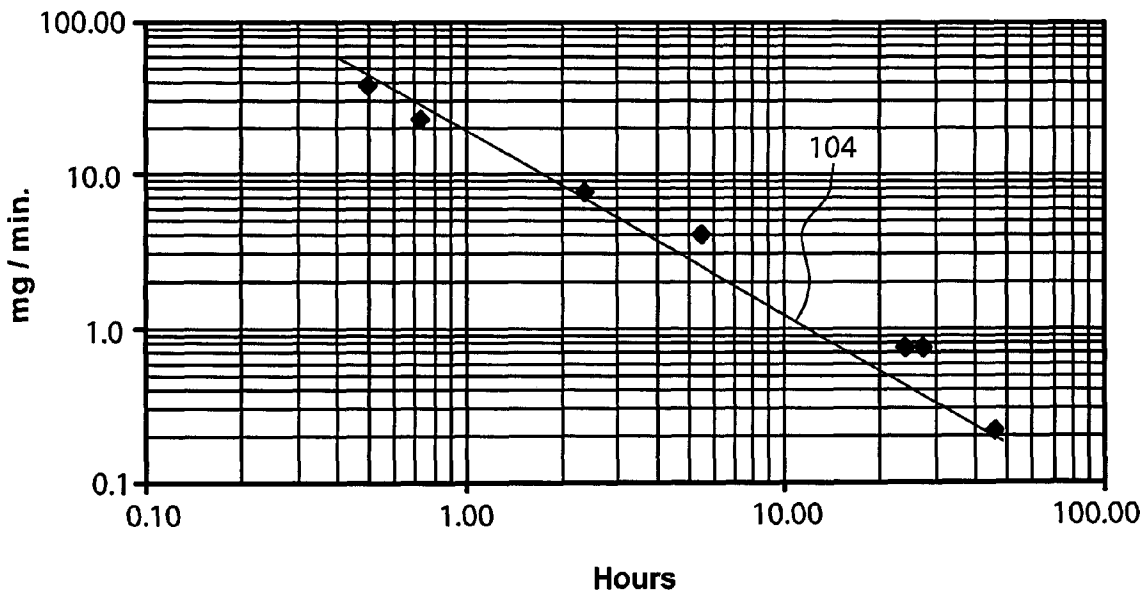
FIG. 12 is a data list and graph illustrating the rate of removal of moisture removed from the high voltage high frequency power supply of FIG. 11 after about an additional 6 days exposure to ambient temperature.

The data and graph illustrating the removal of moisture on the fourth redrying of the high voltage high frequency power supply from the FCR APG-68 tactical radar dual mode transmitter is illustrated in FIG. 12 illustrating a trendline 104 showing a rate of removal as a function of time on a log-log scale.

The method of the invention as will be recognized by those skilled in the art has a wide range of applications to remediating the premature ageing of the FCR APG-68 dual radar transmitters. The invention may be implemented for reconditioning previously repaired high voltage high frequency power supply units as well as units that have not been previously repaired by removing deleterious embedded and absorbed moisture.

Those skilled in the art will also recognize the method of the invention may be used and modified in different ways to suit particular requirements. For example the invention may include separate repair facilities and separate reconditioning facilities as well as separate final reassembly facilities in which case the reconditioned high voltage high frequency power supply unit should be vacuum sealed or packaged in a dry and substantially inert atmosphere.

Those skilled in the art will also recognize that an unheated drying chamber may be utilized where hot dry air is supplied to an evacuated drying chamber. It will also be recognized that the chamber is preferably a vacuum chamber to assist in the removal of embedded moisture.

Those skilled in the art will also recognize the method of the invention provides a wide variety of variations in the use of temperature, pressure and time to remove embedded moisture and absorbed moisture from high voltage high frequency power supply units to increase their useful MTBF. These and other such variations are intended to be included within the scope of the appended claims.

As used herein and in the following claims, the words "comprising" or "comprises" is used in its technical sense to mean the enumerated elements included but do not exclude additional elements which may or may not be specifically included in the dependent claims. It will be understood such additions, whether or not included in the dependent claims, are modifications that both can be made within the scope of the invention. It will be appreciated by those skilled in the art that a wide range of changes and modification can be made to the invention without departing from the spirit and scope of the invention as defined in the following claims:

TERMINOLOGY REFERENCE LIST—High Voltage High Frequency Power Supply

Cockpit 20
Military aircraft 22
Pilot 24
Control stick 26
Avionics panel 28
FCR APG-68 display screen 30
Radar antenna 32
FCR APG-68 dual mode transmitter 34
Nose 36
Buttons 38
Heads up display HUD 40
Sealed aluminum high voltage pressure vessel 42
Protective shrouds or cover 44
Bolts 46
Pressure relief valve 47
Upper housing or cover 48
Liquid or Air cooled cold plate 50
Cap 51
Cooling hose 52
Valve actuator 53
Traveling wave tube (TWT) 54
Coolanol 25 56
Fins 58
Cooling air inlet 60
High voltage high frequency power supply 64
RF modules 66
High voltage wiring 68
Transformers 70
Circuit boards 72
Capacitors 74
High voltage resistors 76
Circulating pump 78
Cooling tubes 80
Vacuum line 81
Healing oven 82
Pressure relief port 83
Fill port 84
Vacuum pump or source 85
Rectangular box (FIG. 7) 90
Line (FIG. 7) 92
Average rate line (FIG. 8) 96
Average rate line (FIG. 9) 98
Average rate line (FIG. 10) 100
Average rate line (FIG. 11) 102
Average rate line (FIG. 12) 104

What is claimed is:

1. A method for removing moisture from a FCR APG-68 tactical radar unit comprising the steps of:

(a) opening a fill valve port and a pressure relief valve port in a tactical radar unit;

(b) placing the tactical radar unit in a heating oven;

(c) providing a vacuum source capable of providing a vacuum of about 10 Torr or below; and (d) heating the heating oven in the range of about 40° to 105° C.

2. The method of claim 1 further comprising the step of removing moisture through a cold trap operated at minus 65° C. or below while the tactical radar unit is in said heating oven.

3. The method of claim 1 further comprising the step of providing a circulating fan in the heating oven and operating the circulating fan during the step of heating.

4. The method of claim 1 wherein the step of providing a vacuum source is achieved by having a combined heating and evacuation heating oven or a heating oven with a separate vacuum source connected to the fill valve port and the pressure relief valve port of the tactical radar unit.

5. The method of claim 2 further comprising the step of backfilling the heating oven or fill valve port and pressure relief valve port with dry nitrogen gas after the step of removing moisture.

6. The method of claim 1 further comprising the step of removing the tactical radar unit from said heating oven and closing the fill valve port and the pressure relief valve port.

7. The method of claim 6 further comprising the step of applying a valve-actuator to the fill valve port and evacuating the interior of the tactical radar unit through the fill valve port and observing and noting pressure after the step of evacuating the interior of the tactical radar unit through the fill valve port.

8. The method of claim 7 further comprising the step of backfilling the tactical radar unit through the fill valve port with sulfur hexafluoride if about after two (2) minutes or more the pressure has not risen more than about 100 milliTorr.

9. The FCR APG-68 tactical radar unit produced by the process of claim 1.

10. A process for removing moisture a FCR APG-68 tactical radar unit wherein the improvement comprises the step of opening at least one port of the FCR APG-68 tactical radar unit and placing the unit in a heating oven and providing a vacuum source and heating the FCR APG-68 unit until it reaches at least 40° C. and then utilizing a vacuum at a pressure below at least 10 Torr for at least 2 hours and then backfilling the FCR APG tactical radar unit with a dry inert gas and then closing the at least one port of the FCR APG-68 tactical radar unit.

11. The process of claim 10 wherein said step of heating is controlled at a temperature in the range of about 40° C. to about 105° C.

12. The process of claim 10 wherein said heating oven is a heating and evacuation chamber which can be operated at below 10 Torr.

13. The process of claim 12 further comprising the step of utilizing a vacuum having a cold trap maintained at a temperature of below about −65° C.

14. The process of claim 13 further comprising the step of employing a valve between said cold trap and the heating oven and measuring the rate of pressure change in the vacuum or moisture concentration build up over a period of time.

15. The process of claim 14 further comprising the step periodically comparing said rate of pressure change or moisture concentration build up to determine when to terminate the process of moisture removal.

16. The process of claim 10 wherein the step of backfilling the FCR APG tactical radar unit with a dry gas is achieved with a dry gas having a dew point below 5° C.

17. The process of claim 10 further comprising utilizing a hygrometer or mass spectrograph to measure a rate of moisture removal.

18. The FCR APG-68 tactical radar unit produced by the process of claim 10.

19. A method of removing moisture from a tactical radar unit to increase its operational life comprising:

(a) opening at least one port of a tactical radar unit;

(b) placing the tactical radar unit in a heating oven;

(c) heating the tactical radar unit until the temperature of the tactical radar unit reaches a temperature of at least 70° C.; and (d) evacuating the heating oven or the tactical radar unit through said at least one port until the pressure is below at least 10 Torr and maintaining the pressure for at least 2 hours.

20. The method of claim 19 further comprising the step of backfilling the heating oven or the tactical radar unit with a dry inert gas.

21. The method of claim 19 wherein the step of evacuating is at a pressure range of about 10 to 10,000 milliTorr.

22. The method of claim 21 further comprising the step of providing a cold trap and maintaining said cold trap at or below 0° C. and evacuating through said cold trap.

23. The method of claim 22 further comprising the step of providing hot dry air to said heating oven or the tactical radar unit through said at least one port.

24. The method of claim 23 wherein said hot dry air is provided at a temperature of between 60 and 85° C.

25. The method of claim 24 wherein said hot dry air is nitrogen.

26. The method of claim 19 further comprising the step of providing a vacuum valve and closing the vacuum valve after heating and evacuating after 2 hours and noting pressure and then noting pressure again after 2 minutes and if pressure has risen more than 100 milliTorr continuing the step of heating and evacuating until pressure does not rise more than 100 milliTorr.

27. The method of claim 19 further comprising the step of backfilling said tactical radar unit with sulfur hexafluoride after removing the tactical radar unit from the heating oven and closing said at least one port.

28. The method of claim 19 wherein said at least one port is a fill valve port and a pressure relief valve port.

29. The tactical radar unit produced by the process of claim 28.

30. The tactical radar unit produced by the process of claim 19.

* * * * *